US010268129B2

(12) United States Patent
Chonan et al.

(10) Patent No.: US 10,268,129 B2
(45) Date of Patent: Apr. 23, 2019

(54) PRESSURE FIXATION TONER FOR DEVELOPING ELECTROSTATIC CHARGE IMAGE, ELECTROSTATIC CHARGE IMAGE DEVELOPER, AND TONER CARTRIDGE

(71) Applicant: FUJI XEROX CO., LTD., Tokyo (JP)

(72) Inventors: Shiori Chonan, Minamiashigara (JP); Sumiaki Yamasaki, Minamiashigara (JP); Satoshi Hiraoka, Minamiashigara (JP); Yasuo Matsumura, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/801,641

(22) Filed: Nov. 2, 2017

(65) Prior Publication Data

US 2018/0275544 A1 Sep. 27, 2018

(30) Foreign Application Priority Data

Mar. 24, 2017 (JP) ..... 2017-058884
Mar. 24, 2017 (JP) ..... 2017-060099

(51) Int. Cl.

| | |
|---|---|
| ***G03G 9/08*** | (2006.01) |
| ***G03G 9/087*** | (2006.01) |
| ***G03G 9/093*** | (2006.01) |
| ***G03G 9/097*** | (2006.01) |

(52) U.S. Cl.

CPC ..... *G03G 9/08708* (2013.01); *G03G 9/0825* (2013.01); *G03G 9/0827* (2013.01); *G03G 9/08711* (2013.01); *G03G 9/08724* (2013.01); *G03G 9/08728* (2013.01); *G03G 9/08795* (2013.01); *G03G 9/08797* (2013.01); *G03G 9/09321* (2013.01); *G03G 9/09364* (2013.01); *G03G 9/09733* (2013.01)

(58) Field of Classification Search

CPC ..... G03G 9/08708; G03G 9/08711; G03G 9/0825; G03G 9/0827
USPC ..... 430/109.3, 110.1, 110.3
See application file for complete search history.

(56) References Cited

U.S. PATENT DOCUMENTS 8,592,121 B2 * 11/2013 Matsumura ..... G03G 9/0804 430/110.1
2009/0053631 A1 2/2009 Matsumura
2009/0226834 A1 9/2009 Matsumura

FOREIGN PATENT DOCUMENTS

| | | |
|---|---|---|
| JP | 2009-053318 A | 3/2009 |
| JP | 2009-244857 A | 10/2009 |
| JP | 2010-175734 A | 8/2010 |
| JP | 2011-017915 A | 1/2011 |

* cited by examiner

*Primary Examiner* — Mark A Chapman
(74) *Attorney, Agent, or Firm* — Oliff PLC

(57) ABSTRACT

A pressure fixation toner for developing an electrostatic charge image includes a styrene resin, a (meth)acrylic acid ester resin, and an oxidative polymerizable compound. The pressure fixation toner has a sea-island structure configured by a sea portion including the styrene resin and island portions including the (meth)acrylic acid ester resin. The (meth)acrylic acid ester resin has a glass transition temperature being lower than a glass transition temperature of the styrene resin by 30° C. or greater.

20 Claims, 2 Drawing Sheets

PRESSURE FIXATION TONER FOR DEVELOPING ELECTROSTATIC CHARGE IMAGE, ELECTROSTATIC CHARGE IMAGE DEVELOPER, AND TONER CARTRIDGE

CROSS-REFERENCE TO RELATED APPLICATIONS

This application is based on and claims priorities under 35 USC 119 from Japanese Patent Application No. 2017-060099 filed on Mar. 24, 2017 and Japanese Patent Application No. 2017-058884 filed on Mar. 24, 2017.

BACKGROUND

Technical Field

The present invention relates to an electrostatic charge image developing toner, an electrostatic charge image developer, and a toner cartridge.

Related Art

A method of visualizing image information, for example, an electrophotographic method is currently used in various fields. In the electrophotographic method, an electrostatic charge image is formed on the surface of an image holding member as image information by charging. A toner image is formed on the surface of the image holding member by using a developer including a toner, and the toner image is transferred onto a recording medium. Then, the toner image is fixed on the recording medium. Image information is visualized as an image, through the above processes.

SUMMARY

According to an aspect of the invention, there is provided a pressure fixation toner for developing an electrostatic charge image. The pressure fixation toner includes a styrene resin, a (meth)acrylic acid ester resin, and an oxidative polymerizable compound.

The pressure fixation toner has a sea-island structure configured by a sea portion including the styrene resin and island portions including the (meth)acrylic acid ester resin.

The (meth)acrylic acid ester resin has a glass transition temperature being lower than a glass transition temperature of the styrene resin by 30° C. or greater.

BRIEF DESCRIPTION OF THE DRAWINGS

Exemplary embodiment(s) of the present invention will be described in detail based on the following figures, wherein.

DETAILED DESCRIPTION

Figure 1:
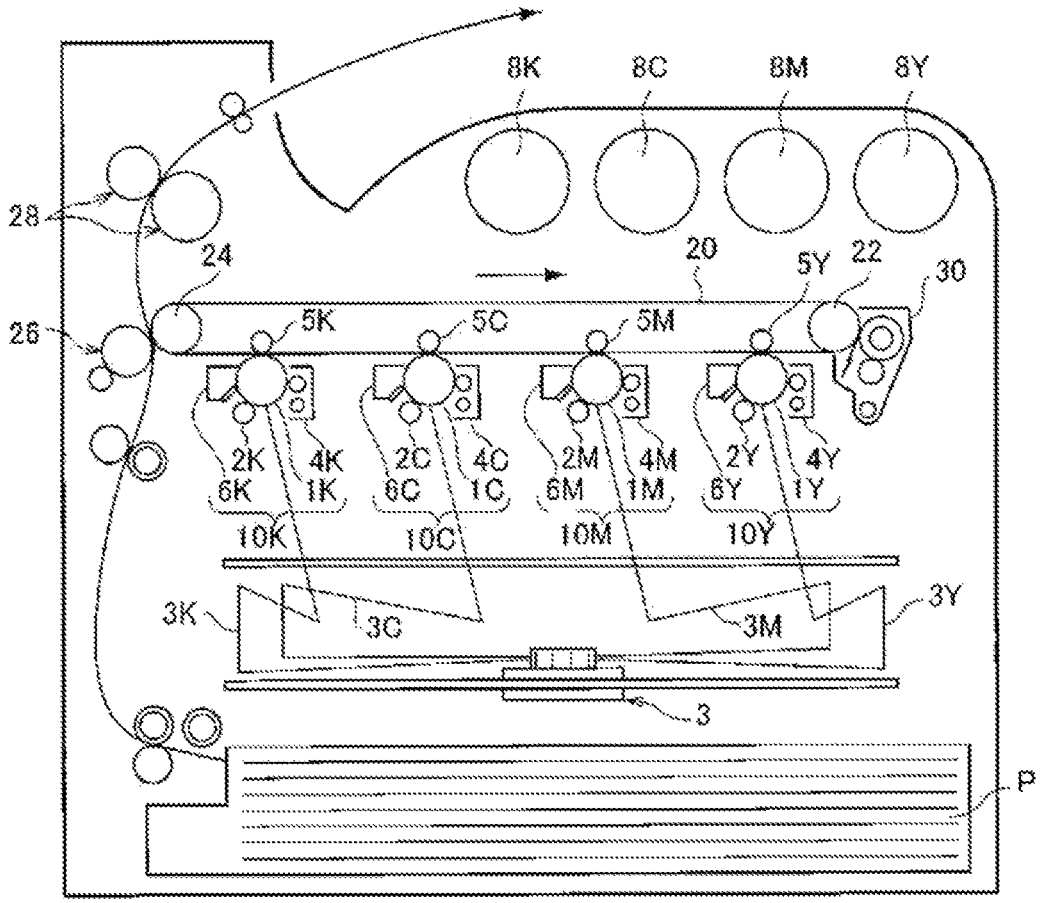
FIG. 1 is a schematic configuration diagram illustrating an example of an image forming apparatus according to an exemplary embodiment.

Hereinafter, an exemplary embodiment as an example of the present invention will be described in detail.

<Electrostatic Charge Image Developing Toner>

A pressure fixation toner for developing an electrostatic charge image according to the exemplary embodiment (also referred to as "a toner" or "a pressure fixation toner" below) includes a styrene resin, a (meth)acrylic acid ester resin, and an oxidative polymerizable compound. Specifically, the pressure fixation toner is a toner having a configuration of including a toner particle which includes the above components.

A core of the pressure fixation toner (toner particle thereof) has a sea-island structure configured by a sea portion including a styrene resin and an island portion including a (meth)acrylic acid ester resin. The glass transition temperature of the (meth)acrylic acid ester resin is lower than that of the styrene resin by 30° C. or greater.

With the above configuration, the pressure fixation toner according to the exemplary embodiment causes an occurrence of set-off (phenomenon in which, when letters and the like are drawn by a writing utensil in a state where recording media onto which a fixed image is fixed overlap each other, a fixed image on the recording medium on a lower side is set off on the back surface of the recording medium on an upper side) to be prevented. The reason is supposed as follows.

The pressure fixation toner is a toner which exhibits plasticity by pressure. As one of the pressure fixation toner, a pressure fixation toner as follows is known. That is, the pressure fixation toner includes a styrene resin and a (meth) acrylic acid ester resin having a glass transition temperature which is lower than that of the styrene resin by 30° C. or greater. The pressure fixation toner includes a toner particle having a sea-island structure which is configured by a sea portion including the styrene resin and an island portion including the (meth)acrylic acid ester resin.

The toner particle having the sea-island structure has higher pressure plasticity and exhibits more excellent pressure fixability, as the major length (for example, major length of 150 nm or smaller) of the island portion is reduced. However, if the major length of the island portion is too small, a mechanical load occurring by stirring and the like is applied, and thus the toner particle may be deformed.

If the sea-island structure in which the major length (for example, major length of 150 nm or smaller) of the island portion is small is exposed to the surface of the toner particle, tendency of the toner particle being deformed is increased.

On the contrary, if the major length of the island portion is set to be in a range of, for example, 200 nm to 500 nm, pressure fixability is secured, the diameter thereof is increased, and mechanical toughness of the toner particle is improved. In this state, if a toner particle having a core/shell structure in which a particle having the sea-island structure is set to be a core and the core is coated with a shell layer which includes a resin having a glass transition temperature of 50° C. or higher is used, exposure of the surface of the sea-island structure is suppressed. Thus, mechanical strength of a surface layer of the toner particle in addition to the inside of the toner particle is also improved, and mechanical toughness of the entirety of the toner particle is improved.

It is supposed that the pressure fixation toner according to the exemplary embodiment causes deformation of the toner to be prevented, from the above descriptions. For example, it is supposed that deterioration of a developing property and poorness of cleaning which occur by deformation of the toner are also prevented.

In the pressure fixation toner according to the exemplary embodiment, at least one of the styrene resin, the (meth) acrylic acid ester resin, or the resin of the shell layer (coating layer) is preferably a resin having a siloxane structure. That is, it is preferable that at least one resin of the above resins has a siloxane structure.

A fixed image formed with a pressure fixation toner including a toner particle which includes a styrene resin and a (meth)acrylic acid ester resin having a glass transition temperature which is lower than that of the styrene resin by 30° C. or greater has a tendency to deteriorate strength of a fixed image because of including a resin which has a low glass transition temperature. There is a tendency that the (meth)acrylic acid ester resin having a low glass transition temperature is unevenly distributed in the surface layer of the fixed image and stickiness on the surface of the fixed image is exhibited. Therefore, if letters and the like are drawn by a writing utensil in a state where recording media onto which a fixed image is fixed overlap each other, a fixed image on the recording medium on a lower side may be set off on the back surface of the recording medium on an upper side. When recording media onto which a toner image is fixed are stacked, a phenomenon in which a fixed image on the recording medium after fixing is moved to another recording medium may occur. That is, document offset may occur.

On the contrary, if the pressure fixation toner includes an oxidative polymerizable compound, the oxidative polymerizable compound provided in the toner is brought into contact with oxygen in an air in a fixed image by the pressure fixation toner, and thus a polymerization reaction is caused. Thus, strength of the fixed image is improved and it is also difficult to exhibit stickiness. Therefore, even if pressure by a writing utensil is applied, it is difficult to cause set-off of a fixed image on a recording medium on a lower side to occur on the back surface of a recording medium on an upper side.

It is supposed that the pressure fixation toner according to the exemplary embodiment causes the occurrence of set-off to be prevented, from the above descriptions.

Here, the pressure fixation toner according to the exemplary embodiment may be a single-layer type toner or may be a core-shell toner which includes a core and a shell layer for coating the core. That is, the pressure fixation toner may have a configuration of including a single-layer type toner particle, or may have a configuration of including a core-shell toner particle which includes a core and a shell layer.

In a case of a core-shell toner (core-shell toner particle), the core has a configuration of having a sea-island structure. That is, the core includes a styrene resin, a (meth)acrylic acid ester resin, and an oxidative polymerizable compound, and a sea-island structure configured by a sea portion including the styrene resin and an island portion including the (meth)acrylic acid ester resin is provided.

Here, the oxidative polymerizable compound may also be included in the shell layer. However, from a viewpoint of preventing an occurrence of oxidation polymerization of the oxidative polymerizable compound on a surface of the toner (toner particle), it is preferable that the oxidative polymerizable compound is not included in the shell layer.

In the pressure fixation toner according to the exemplary embodiment, it is preferable that at least one of the styrene resin, the (meth)acrylic acid ester resin, or the resin of the shell layer is a resin including an allyl group, from a viewpoint of preventing the occurrence of set-off. That is, it is preferable that at least one resin of the above resins includes an allyl group. The resin of the shell layer may be a styrene resin including an allyl group.

If the resin including an allyl group is applied, the allyl group of the resin reacts with the oxidative polymerizable compound in a fixed image by the pressure fixation toner. Thus, strength of the fixed image is more improved and stickiness is also deteriorated more. Therefore, the occurrence of set-off is easily prevented.

If the resin including an allyl group is applied as the (meth)acrylic acid ester resin among the three types of resins, the occurrence of set-off is more easily prevented. In particular, if the (meth)acrylic acid ester resin is the resin including an allyl group, the (meth)acrylic acid ester resin which is unevenly distributed in the surface layer of a fixed image reacts with the oxidative polymerizable compound. Thus, strength of the fixed image is further improved and stickiness is also deteriorated further. Therefore, it is preferable that the (meth)acrylic acid ester resin is the resin including an allyl group.

In order to introduce an allyl group to each of the three types of resins, for example, a monomer for synthesizing each of the resins and a monomer including an allyl group are used. The monomer including an allyl group will be described later.

From a viewpoint of achieving fixability and prevention of the occurrence of set-off, the content of the allyl group with respect to the resin is preferably from 1 mmol % to 20 mmol %, more preferably from 3 mmol % to 15 mmol %, and further preferably from 5 mmol % to 15 mmol %.

If a resin having a siloxane structure is applied as at least one of the three types of resins, the occurrence of document offset is prevented. It is considered that the reason is because the siloxane structure of the resin is unevenly distributed in the surface of a fixed image, and thus releasability of the fixed image is improved (that is, because frictional force for the fixed image is reduced).

If the resin having the siloxane structure is applied as at least one of the (meth)acrylic acid ester resin or the resin of the shell layer among the three types of resins, particularly, as the (meth)acrylic acid ester resin, it is easy to more prevent the occurrence of document offset. The reason is considered as follows. That is, the (meth)acrylic acid ester resin and the resin of the shell layer, particularly, the (meth)acrylic acid ester resin having a low glass transition temperature is easily unevenly distributed in the surface layer of a fixed image, and the siloxane structure of the resin is unevenly distributed in the surface of the fixed image with high efficiency. Thus, the releasability of the fixed image is improved (that is, frictional force for the fixed image is reduced).

In order to introduce a siloxane structure to each of the three types of resins, for example, a monomer for synthesizing each of the resins and a monomer having a siloxane structure are used. The monomer having a siloxane structure will be described later.

In the resin having a siloxane structure, from a viewpoint of preventing the occurrence of document offset, the percentage of the siloxane structure occupied in the resin is preferably from 1% to 20%, more preferably from 1% to 15%, and further preferably from 2% to 10% in weight ratio.

The pressure fixation toner according to the exemplary embodiment will be described below in detail.

The pressure fixation toner according to the exemplary embodiment includes toner particles. A toner may include an external additive for being externally added to the toner particle.

A core-shell toner particle which includes a core and a shell layer will be described as the toner particle. However, it is not limited thereto, and the toner particle may be a single-layer type toner particle.

[Toner Particle]

The toner particle includes a core and a shell layer. The core includes a styrene resin, a (meth)acrylic acid ester resin, and an oxidative polymerizable compound. The shell layer includes a resin which is used for coating the core and has a glass transition temperature of 50° C. or higher.

The core may include a colorant, a release agent, and other additives in addition to the styrene resin and the (meth)acrylic acid ester resin as a binder resin.

(Core)

—Sea-Island Structure—

The sea-island structure of the core indicates a structure in which a sea portion including the styrene resin is set as a continuous phase and island portions including the (meth) acrylic acid ester resin are dispersed as a dispersed phase.

The sea portion may include other components (other binder resins and the like) along with the styrene resin. Similarly, the island portion may also include other components (release agent and the like) along with the (meth) acrylic acid ester resin. As the island portion, an island portion of only the (meth)acrylic acid ester resin and an island portion of only other components (release agent and the like) may be mixed.

Here, the oxidative polymerizable compound may be included any of the sea portion and the island portion.

There is a tendency that, as the major length of the island portion in the sea-island structure is reduced, pressure plasticity is improved, pressure fixability is improved, and the toner particle is easily deformed. In addition, there is a tendency that, as the major length of the island portion in the sea-island structure is increased, the pressure plasticity is deteriorated, the pressure fixability is deteriorated, and the toner particle is easily deformed. Therefore, it is preferable that the major length of each island portion in the sea-island structure is set to be from 200 nm to 500 nm. From a viewpoint of pressure fixability and prevention of deforming the toner, the major length of each island portion in the sea-island structure is more preferably from 200 nm to 450 nm, and further preferably from 250 nm to 400 nm.

However, in a case of giving priority to the pressure fixability, the major length of each island portion may be less than 200 nm (for example, range of 150 nm, range of 5 nm to 150 nm, range of 50 nm to 140 nm, range of 100 nm to 130 nm).

As a method of setting the major length of each island portion in the sea-island structure to be in the range of 200 nm to 500 nm, for example, a method of using a styrene resin particle in which plural domains of the (meth)acrylic acid ester resin are dispersed (that is, a resin particle in which the styrene resin is used as a base material and plural domains of the (meth)acrylic acid ester resin are dispersed in the base material) when a toner is produced by an emulsion aggregating method method is exemplified.

Confirmation of the sea-island structure and measurement of the major length of each island portion are performed by methods as follows.

After the toner is embedded in an epoxy resin, a slice is produced by using a diamond knife and the like. The produced slice is colored by using osmium tetroxide or ruthenium tetroxide in a desiccator, and then the colored slice is observed by a transmission electron microscope. The sea portion and the island portions in the sea-island structure are distinguished from each other by density which occurs by the degree of coloring the resin with osmium tetroxide. It is confirmed whether or not the sea-island structure is provided, by using this distinguishment. Even in a case of including a release agent, the sea portion and the island portions may be distinguished from each other by density which occurs by the degree of coloring the resin with osmium tetroxide. Regarding the degrees of coloring the styrene resin, the (meth)acrylic acid ester resin, and the release agent, the resins are colored dark in an order of the (meth)acrylic acid ester resin, the styrene resin, and the release agent.

100 island portions are selected and an average value of the major lengths of the island portions is calculated, by using a LUZEX image analyzer. Each of the major lengths of the island portions means the maximum diameter in each island portion.

—Binder Resin—

The styrene resin and the (meth)acrylic acid ester resin are applied as the binder resin.

The glass transition temperature of the (meth)acrylic acid ester resin is lower than that of the styrene resin by 30° C. or greater. That is, a difference of the glass transition temperature between the styrene resin and the (meth)acrylic acid ester resin is equal to or greater than 30° C., and the glass transition temperature of the (meth)acrylic acid ester resin is lower than that of the styrene resin.

In the specification, the styrene resin is also referred to as "a high-Tg styrene resin" and the (meth)acrylic acid ester resin is also referred to as "a low-Tg (meth)acrylic acid ester resin".

From a viewpoint of improving pressure fixability, the difference of the glass transition temperature between the styrene resin and the (meth)acrylic acid ester resin is preferably equal to or greater than 35° C.

From a viewpoint of improving pressure fixability, the glass transition temperature of the styrene resin is preferably equal to or higher than 40° C., more preferably 40° C. or higher and lower than 60° C., and further preferably 40° C. or higher and lower than 55° C.

From a viewpoint of improving pressure fixability, the glass transition temperature of the (meth)acrylic acid ester resin is preferably lower than 10° C., more preferably −100° C. or higher and lower than 10° C., and further preferably −80° C. or higher and lower than 10° C.

The glass transition temperature of each of the resins may mainly be controlled in accordance with density of a rigid unit such as an aromatic ring and a cyclohexane ring, in the main chain of the resin. That is, the glass transition temperature has a tendency to be decreased if the density of a flexible unit such as a methylene group, an ethylene group, and an oxyethylene group in the main chain is increased. In addition, the glass transition temperature has a tendency to be increased if the rigid unit such as an aromatic ring and a cyclohexane ring is more provided. If the density of, for example, an aliphatic branch is increased, the glass transition temperature has a tendency to be decreased. Considering the above descriptions, resins having various glass transition temperatures are obtained.

Here, in this specification, the glass transition temperature of each of the resins is obtained by using a DSC curve which is obtained by differential scanning calorimetry (DSC). More specifically, the glass transition temperature thereof is obtained in accordance with the "extrapolated glass transition initiation temperature" disclosed in the section of the method of obtaining a glass transition temperature in JIS K7121-1987 "Testing Methods for Transition Temperatures of Plastics".

Next, a configuration of the styrene resin will be described.

The styrene resin is a resin in which a styrene monomer (monomer having a styrene skeleton) is at least polymerized.

The styrene resin may be a homopolymer of the styrene monomer, or may be a copolymer of the styrene monomer and another monomer.

If the styrene resin and the (meth)acrylic acid ester resin has a difference of the glass transition temperature, which is equal to or greater than 30° C., resins of the same kind (copolymer in which the same monomer is polymerized) may be provided. That is, any of the styrene resin and the (meth)acrylic acid ester resin may be a copolymer in which a styrene monomer and (meth)acrylic acid ester are at least polymerized.

Examples of the styrene monomer include styrene; vinyl naphthalene; alkyl-substituted styrene such as α-methyl styrene, o-methyl styrene, m-methylstyrene, p-methyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decylstyrene, and p-n-dodecyl styrene; aryl-substituted styrene such as p-phenylstyrene; alkoxy-substituted styrene such as p-methoxystyrene; halogen-substituted styrene such as p-chlorostyrene, 3,4-dichlorostyrene, 4-fluorostyrene, and 2,5-difluorostyrene; and nitro-substituted styrene such as m-nitrostyrene, o-nitrostyrene, and p-nitrostyrene.

Among the substances, styrene, p-ethylstyrene, p-n-butylstyrene, and the like are preferable, and styrene is more preferable.

A ratio of a styrene monomer with respect to all monomer components (that is, a ratio of a constituent unit derived from the styrene monomer with respect to the styrene resin) is preferably from 15% by weight to 95% by weight, and more preferably from 40% by weight to 90% by weight.

The monomer may be singly used or may be used in combination of two kinds or more thereof.

Next, a configuration of the (meth)acrylic acid ester resin will be described.

The (meth)acrylic acid ester resin is a polymer in which (meth)acrylic acid ester is at least polymerized.

The (meth)acrylic acid ester resin may be a homopolymer of (meth)acrylic acid ester, or may be a copolymer obtained by polymerizing (meth)acrylic acid ester and another resin.

Examples of (meth)acrylic acid ester include (meth) acrylic acid alkyl ester, di(meth)acrylic acid ester, (meth) acrylic acid carboxy-substituted alkyl ester, (meth)acrylic acid hydroxy-substituted alkyl ester, and (meth)acrylic acid alkoxy-substituted alkyl ester.

Examples of (meth)acrylic acid alkyl ester include (meth) acrylic acid, n-methyl (meth)acrylate, n-ethyl (meth)acrylate, n-propyl (meth)acrylate, n-butyl (meth)acrylate, n-pentyl (meth)acrylate, n-hexyl (meth)acrylate, n-heptyl (meth) acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, octyl (meth) acrylate, decyl (meth)acrylate, lauryl (meth)acrylate, stearyl (meth)acrylate, cyclohexyl (meth)acrylate, dicyclopentanyl (meth)acrylate, and isobornyl (meth)acrylate.

Examples of di(meth)acrylic acid ester includes ethylene glycol di(meth)acrylate, diethylene glycol di(meth)acrylate, triethylene glycol di(meth)acrylate, butanediol di(meth) acrylate, pentane diol di(meth)acrylate, hexanediol di(meth) acrylate, nonanediol di(meth)acrylate, and decanediol di(meth)acrylate.

Examples of (meth)acrylic acid carboxy-substituted alkyl ester include β-carboxyethyl (meth)acrylate.

Examples of (meth)acrylic acid hydroxy-substituted alkyl ester include 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, and 4-hydroxybutyl (meth)acrylate.

Examples of (meth)acrylic acid alkoxy-substituted alkyl ester include 2-methoxyethyl (meth)acrylate.

Among the above substances, (meth)acrylic acid alkyl ester which includes an alkyl group having 2 to 22 carbon atoms is preferable as the (meth)acrylic acid ester.

A percentage of the (meth)acrylic acid ester with respect to all monomer components (that is, percentage of a constituent unit derived from the (meth)acrylic acid ester with respect to the (meth)acrylic acid ester resin) is preferably from 10% by weight to 100% by weight, and more preferably from 20% by weight to 100% by weight.

Next, other monomers of the styrene resin and the (meth) acrylic acid ester resin will be described.

Examples of other monomers include ethylenically unsaturated nitriles such as acrylonitrile and methacrylonitrile; ethylenically unsaturated carboxylic acid such as acrylic acid, methacrylic acid, and crotonic acid; vinyl ether such as vinyl methyl ether and vinyl isobutyl ether; vinyl ketone such as vinyl methyl ketone, vinyl ethyl ketone, and vinyl isopropenyl ketone; and olefin such as isoprene, butene, and butadiene.

Examples of the styrene resin also include (meth)acrylic acid ester described above. Examples of the other monomer of the (meth)acrylic acid ester resin also include a styrene monomer described above.

Here, the styrene resin and the (meth)acrylic acid ester resin may include an acidic polar group (carboxy group, sulfonic acid group, acid anhydride, and the like), a basic polar group (amino group, amide group, hydrazide group, and the like), and an alcoholic hydroxyl group.

Therefore, examples of the other monomer also include a monomer including an acidic polar group, a monomer including a basic polar group, and a monomer including an alcoholic hydroxyl group.

Examples of the monomer including an acidic polar group include α,β-ethylenically unsaturated compound (acrylic acid, methacrylic acid, fumaric acid, maleic acid, itaconic acid, cinnamic acid, sulfonated styrene, allylsulfosuccinic acid, and the like).

Examples of the monomer including a basic polar group preferably include a monomer including a nitrogen atom (for example, (meth)acrylic acid amide compound, (meth)acrylic acid hydrazide compound, or (meth)acrylic acid aminoalkyl).

Examples of the (meth)acrylic acid amide compound include acrylic acid amide, methacrylic acid amide, acrylic acid methylamide, methacrylic acid methylamide, acrylic acid dimethylamide, acrylic acid diethylamide, acrylic acid phenylamide, and acrylic acid benzylamide.

Examples of the (meth)acrylic acid hydrazide compound include acrylic acid hydrazide, methacrylic acid hydrazide, acrylic acid methyl hydrazide, methacrylic acid methyl hydrazide, acrylic acid dimethyl hydrazide, and acrylic acid phenyl hydrazide.

Examples of aminoalkyl (meth)acrylate include (meth) acrylic acid monoalkyl aminoalkyl (for example, 2-aminoethyl acrylate, 2-aminoethyl methacrylate, and the like) and (meth)acrylic acid dialkyl aminoalkyl (for example, 2-(diethylamino)ethyl methacrylate and the like).

Examples of the monomer including an alcoholic hydroxyl group include (meth)acrylic acid hydroxy-substituted alkyl ester which is exemplified for (meth)acrylic acid ester.

Examples of other monomers also include a monomer including an allyl group.

Examples of the monomer including an allyl group include allyl (meth)acrylate, N-allyl (meth)acrylamide, N,N-diallyl (meth)acrylamide, N-alkyl-N-allyl (meth)acrylamide (for example, "N-alkyl-N-allyl (meth)acrylamide which has an alkyl group having 1 to 10 carbon atoms" such as N-methyl-N-allyl (meth)acrylamide, N-ethyl-N-allyl (meth)acrylamide, and N-butyl-N-allyl (meth)acrylamide), N-phenyl-N-allyl (meth)acrylamide, and N-substituted phenyl-N-allyl (meth)acrylamide (for example, "N-substituted phenyl-N-allyl (meth)acrylamide which has a phenyl group substituted with an alkyl group having 1 to 5 carbon atoms" such as N-(2-tert-butylphenyl)-N-allyl acrylamide and N-(2,5-di-tert-butylphenyl)-N-allylacrylamide).

Among the substances, from a viewpoint of preventing the occurrence of set-off, allyl methacrylate is preferable as the monomer including an allyl group.

Each of the monomers described above may be singly used or may be used in combination of two kinds or more thereof.

Examples of other monomers also include a monomer having a siloxane structure (also referred to as "a silicone compound" below).

Here, examples of the siloxane structure (polysiloxane chain) include a siloxane structure represented by a formula of $—(O—Si(R^s)_2)_n—$.

In the formula, two $R^s$s each respectively indicate a hydrogen atom, an alkyl group having 1 to 6 carbon atoms, or a phenyl group, and preferably indicates a methyl group, an ethyl group, or a phenyl group.

n indicates an integer of 1 or more and preferably indicates an integer of 1 to 3.

The silicone compound may be a monomer or a macromonomer. The "macromonomer" is a general term of oligomers or polymers (polymerization degree of about 2 to 300) having a polymerizable functional group. The macromonomer has properties of both a polymer and a monomer. The monomer having a siloxane structure may be singly used or may be used in combination of plural monomers.

Examples of a straight-chain type silicone compound include a dimethyl silicone compound having a (meth) acrylate group at one terminal (silicone compounds represented by Formula (1): for example, SILAPLANE FM-0711, FM-0721, FM-0725, and the like (manufactured by JNC Corporation), and X-22-174BX, X-22-174DX, X-22-2426, X-22-2475, and the like (manufactured by Shin-Etsu Chemical Co., Ltd)).

Examples of a branched type silicone compound include silicone compounds represented by Formulas (2) to (7).

Structural Formula (1)

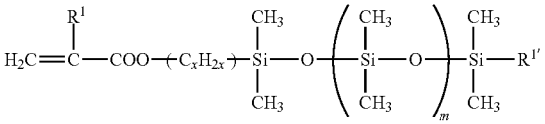

In Formula (1), $R^1$ indicates a hydrogen atom or a methyl group. $R^{1'}$ indicates a hydrogen atom or an alkyl group having 1 to 4 carbon atoms. m indicates a natural number (for example, range of 1 to 1000, preferably range of 3 to 100). x indicates an integer of 1 to 3.

Structural Formula (2)

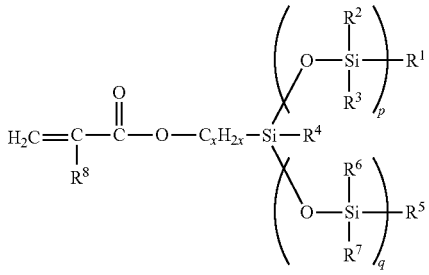

Structural Formula (3)

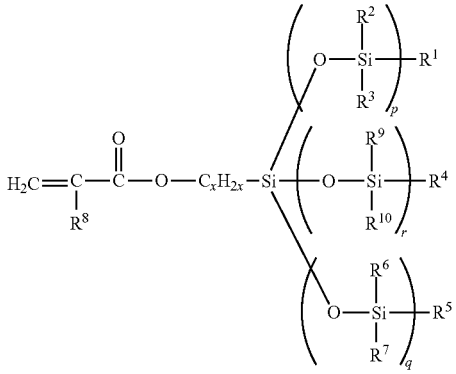

Structural Formula (4)

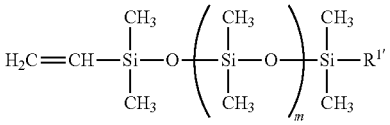

Structural Formula (5)

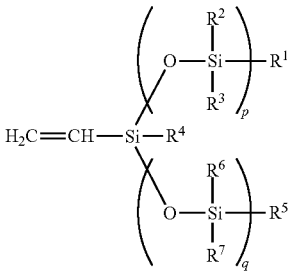

Structural Formula (6)

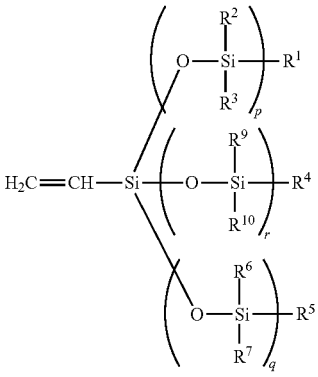

-continued

Structrual Formula (7)

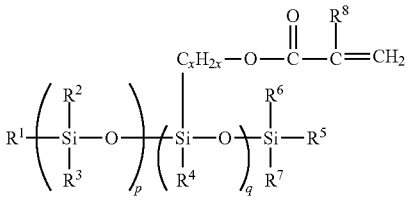

In Formulas (2), (3), (5), (6), and (7), $R^1$, $R^2$, $R^3$, $R^4$, $R^5$, $R^6$, $R^7$, $R^9$, and $R^{10}$ each independently indicate a hydrogen atom, an alkyl group having 1 to 4 carbon atoms, or a fluoroalkyl group having 1 to 4 carbon atoms. $R^8$ indicates a hydrogen atom or a methyl group. p, q, and r each independently indicate an integer of 1 to 1000. x indicates an integer of 1 to 3.

In Formula (4), $R^{1'}$ indicates a hydrogen atom or an alkyl group having 1 to 4 carbon atoms. m indicates a natural number (for example, range of 1 to 1000, preferably range of 3 to 100). x indicates an integer of 1 to 3.

The silicone compounds represented by Formulas (2) and (5) preferably have a form in which $R^1$ and $R^5$ indicate a butyl group, $R^2$, $R^3$, $R^4$, $R^6$, and $R^7$ indicate a methyl group, $R^8$ indicates a methyl group, p and q each independently indicate an integer of 1 to 5, and x indicates an integer of 1 to 3.

The silicone compounds represented by Formulas (3) and (6) preferably have a form in which $R^1$, $R^2$, $R^3$, $R^4$, $R^5$, $R^6$, $R^7$, $R^9$, and $R^{10}$ indicate a methyl group, $R^8$ indicates a hydrogen atom or a methyl group, p, q, and r each independently indicate an integer of 1 to 3, and x indicates an integer of 1 to 3.

The silicone compound represented by Formula (7) preferably have a form in which $R^1$, $R^2$, $R^3$, $R^4$, $R^5$, $R^6$, $R^7$, $R^9$, and $R^{10}$ indicate a methyl group, $R^8$ indicates a hydrogen atom or a methyl group, p and q each independently indicate an integer of 1 to 5, and x indicates an integer of 1 to 3.

Examples of the silicone compound represented by Formula (2) include MCS-M11 and MFS-M15 manufactured by Gelest Inc. Examples of the silicone compound represented by Formula (3) include RTT-1011 manufactured by Gelest Inc., and X22-2404 manufactured by Shin-Etsu Chemical Co., Ltd. Examples of the silicone compound represented by Formula (4) include MCR-V21 manufactured by Gelest Inc. Examples of the silicone compound represented by Formula (5) include MCS-V12 manufactured by Gelest Inc. Examples of the silicone compound represented by Formula (6) include VTT-106 manufactured by Gelest Inc. Examples of the silicone compound represented by Formula (7) include RMS-044, RMS-033, and RMS-083 manufactured by Gelest Inc. Representative formulas of the silicone compounds are shown below.

Regarding MCS-M11, in the above formula, m and n each independently indicate an integer of 2 to 4 and the molecular weight thereof is from 800 to 1000.

RTT-1011

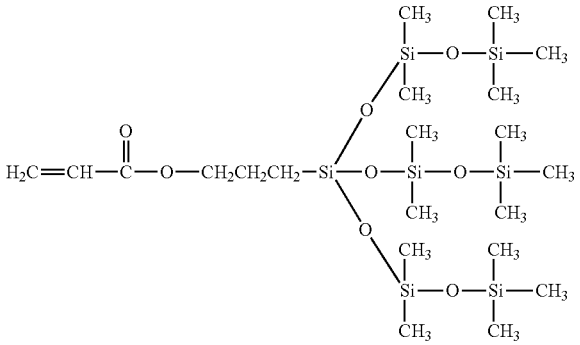

RTT-1011 is a compound represented by the above formula.

X22-2404

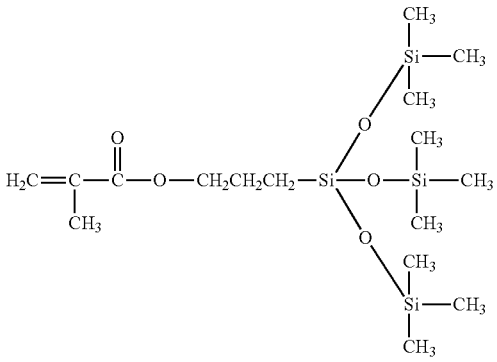

X22-2404 is a compound represented by the above formula.

MCR-V21

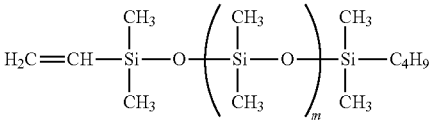

MCS-M11

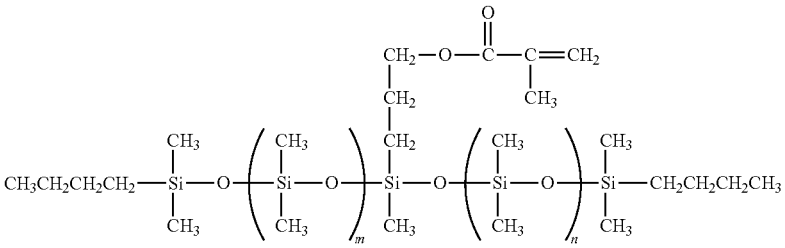

Regarding MCR-V21, in the above formula, m indicates an integer of 72 to 85, and the molecular weight thereof is from 5500 to 6500.

MCS-V12

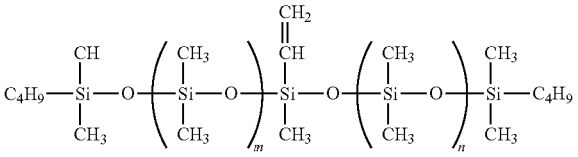

Regarding MCS-V12, in the above formula, m and n indicate an integer of 6 to 10, and the molecular weight thereof is from 1200 to 1400.

VTT-106

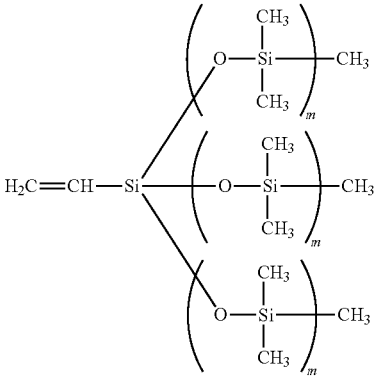

(CAS: [126581-51-9]TSCA)

VTT-106 is a compound represented by the above formula.

A method of introducing a siloxane structure to each of the resins is not limited to a method of using a silicone compound which has a siloxane structure and includes a (meth)acryloyl group. In addition, a method of using a copolymer in which at least two components of a silicone compound which has a siloxane structure and includes a (meth)acryloyl group, and glycidyl (meth)acrylate or an isocyanate monomer (Showa denko Corporation: KARENZ AOI, KARENZ MOI) or a method of using a silicone compound which has a siloxane structure and includes various reactive groups, such as a silicone compound (X-22-173DX and the like manufactured by Shin-Etsu Chemical Co., Ltd) which has a siloxane structure and includes an epoxy group.

Next, the contents and other characteristics of the styrene resin and (meth)acrylic acid ester resin will be described.

The total percentage of the styrene resin and the (meth) acrylic acid ester resin (percentage with respect to the entirety of the binder resin) may be equal to or greater than 85% by weight, for example. The total percentage thereof is preferably equal to or greater than 95% by weight, and more preferably equal to or greater than 100% by weight.

The weight ratio "(meth)acrylic acid ester resin/styrene resin)" of the (meth)acrylic acid ester resin to the styrene resin is preferably equal to or greater than 0.25, more preferably equal to or greater than 0.3, further preferably equal to or greater than 0.4, and particularly preferably equal to or greater than 0.5, from a viewpoint of pressure fixability and prevention of deforming the toner. The weight ratio thereof is preferably smaller than 1.5 from a viewpoint of preventing plasticization at a normal temperature (for example, 25° C.) of the toner.

In a case where a styrene (meth)acrylic resin is applied as the resin of the shell layer, the content of the styrene (meth)acrylic resin means the total content of the styrene (meth)acrylic resin in the core and the shell layer.

A weight average molecular weight of the styrene resin is preferably from 3,000 to 50,000 and more preferably from 5,000 to 40,000, from a viewpoint of pressure fixability and strength of a fixed image.

A weight average molecular weight of the (meth)acrylic acid ester resin is preferably from 3,000 to 50,000 and more preferably from 5,000 to 40,000, from a viewpoint of pressure fixability and prevention of an occurrence of toner filming on an image holding member (phenomenon in which a toner adheres to the surface of the image holding member, so as to have a thin film shape).

The weight average molecular weight of the resin is measured by gel permeation chromatography (GPC). When the molecular weight is measured by GPC, GPC•HLC-8120GPC manufactured by Tosoh Corporation is used as a measurement device, glass TSKgel SuperHM-M (15 cm) manufactured by Tosoh Corporation is used, and the measurement is performed in a THF solvent. The weight average molecular weight is calculated by using a molecular weight calibration curve which is created from the measurement result by a monodisperse polystyrene standard sample.

Next, other binder resins other than the styrene resin and the (meth)acrylic acid ester resin will be described.

As the binder resin, other binder resins other than the styrene resin and the (meth)acrylic acid ester resin may be used together.

Examples of other binder resins include homopolymers of monomers of styrenes (for example, styrene, parachlorostyrene and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, vinyl isopropenyl ketone, and the like), olefins (for example, ethylene, propylene, and butadiene), and the like, or a vinyl resin formed from a copolymer obtained by combining two kinds or more of the monomers.

Examples of other binder resins include a non-vinyl resin such as an epoxy resin, a polyester resin, a polyurethane resin, a polyamide resin, a cellulose resin, a polyether resin, and a modified rosin, a mixture of the above resin and the vinyl resin, and a graft polymer obtained by polymerizing a vinyl monomer under coexistence of the resins.

The other binder resins may be singly used or may be used in combination of two kinds or more thereof.

For example, the content of the binder resin is preferably from 40% by weight to 95% by weight, more preferably from 50% by weight to 90% by weight, and further preferably from 60% by weight to 85% by weight, with respect to all toner particles.

—Oxidative Polymerizable Compound—

As the oxidative polymerizable compound, a compound obtained in a manner that an oxidation polymerization reaction by a reaction with oxygen in an air proceeds is provided.

Examples of the oxidative polymerizable compound include a phenol derivative in which an aliphatic hydrocarbon group including an ethylenic double bond is bonded to phenol, a drying oil, and fatty acid which includes an aliphatic hydrocarbon group having an ethylenic double bond.

Among the substances, at least one selected from the group consisting of the phenol derivative in which an aliphatic hydrocarbon group including an ethylenic double bond is bonded to phenol, and the drying oil is preferable as the oxidative polymerizable compound.

Examples of the phenol derivative include anacardic acid, anagiganic acid, perranjic acid, ginkgotic acid, ginkgolinic acid, cardanol, cardol, methyl cardol, urushiol, thithiol, renghol, and laccole.

The drying oil is an oil including fatty acid (palmitoleic acid, oleic acid, linoleic acid, linolenic acid, and the like) which has an aliphatic hydrocarbon group having an ethylenic double bond.

Examples of the drying oil include a linseed oil, a tung oil, a poppy seed oil, a perilla seed oil, a sunflower oil, a safflower oil, a soybean oil, a rice bran oil, a cottonseed oil, and a sesame oil.

The oxidative polymerizable compound may be singly used or may be used in combination of two kinds or more thereof.

From a viewpoint of preventing the occurrence of set-off, the iodine number of the oxidative polymerizable compound is preferably equal to or greater than 130 g/100 g, and more preferably equal to or greater than 170 g/100 g.

Examples of the oxidative polymerizable compound having an iodine number of 130 g/100 g or greater include a phenol derivative such as cardanol and urushiol; and a drying oil such as a linseed oil, a tung oil, a safflower oil, a poppy seed oil, a perilla oil, a perilla seed oil, a sunflower oil, and a safflower oil.

From a viewpoint of preventing the occurrence of set-off, the content of the oxidative polymerizable compound is preferably from 1% by weight to 25% by weight, more preferably from 1% by weight to 20% by weight, and further preferably from 3% by weight to 15% by weight, with respect to the toner (toner particle).

—Colorant—

Examples of the colorant include various pigments or various dyes. Examples of the various pigments include carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, calco oil blue, methylene blue chloride, phthalocyanine blue, pigment blue, phthalocyanine green, and malachite green oxalate. Examples of the various dyes include acridines, xanthenes, azos, benzoquinones, azines, anthraquinones, thioindigoes, dioxazines, thiazines, azomethines, indigoes, phthalocyanines, aniline blacks, polymethines, triphenyl methanes, diphenyl methanes, and thiazoles.

The colorant may be singly used or may be used in combination of two kinds or more thereof.

As the colorant, a colorant subjected to surface treatment, if necessary, may be used or the colorant may be used along with a dispersant. Combination of plural kinds of colorants may be used.

For example, the content of the colorant is preferably from 1% by weight to 30% by weight and more preferably from 3% by weight to 15% by weight, with respect to all toner particles.

—Release Agent—

Examples of the release agent include a hydrocarbon wax; a natural wax such as a carnauba wax, a rice wax, and a candelilla wax; synthesis of a montan wax or a mineral•petroleum wax; and an ester wax such as fatty acid ester and montanic acid ester. The release agent is not limited thereto.

The melting temperature of the release agent is preferably from 50° C. to 110° C. and more preferably from 60° C. to 100° C.

The melting temperature is obtained from a DSC curve in accordance with the "melting peak temperature" disclosed in the section of the method of obtaining a melting temperature in JIS K7121-1987 "Testing Methods for Transition Temperatures of Plastics". The DSC curve is obtained by differential scanning calorimetry (DSC).

For example, the content of the release agent is preferably from 1% by weight to 20% by weight and more preferably from 5% by weight to 15% by weight, with respect to all toner particles.

—Other Additives—

Examples of other additives include known additives such as a magnetic material, a charge-controlling agent, and an inorganic powder material. The additives are included as an internal additive, in the toner particle.

(Shell Layer)

The shell layer is a resin layer. Specifically, it is preferable that the shell layer includes a resin having a glass transition temperature of 50° C. or higher, from a viewpoint of preventing deformation of the toner.

The glass transition temperature of the resin in the shell layer is preferably from 50° C. to 110° C. and more preferably from 50° C. to 90° C., from a viewpoint of pressure fixability and prevention of deforming the toner.

Examples of the resin of the shell layer include homopolymers of monomers of styrenes (for example, parachlorostyrene and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, vinyl isopropenyl ketone, and the like), olefins (for example, ethylene, propylene, and butadiene), and the like, or a vinyl resin formed from a copolymer obtained by combining two kinds or more of the monomers.

Examples of the known binder resin include a non-vinyl resin such as an epoxy resin, a polyester resin, a polyurethane resin, a polyamide resin, a cellulose resin, a polyether resin, and a modified rosin, a mixture of the above resin and the vinyl resin, and a graft polymer obtained by polymerizing a vinyl monomer under coexistence of the resins.

The binder resin may be singly used or may be used in combination of two kinds or more thereof.

In particular, it is preferable that the styrene resin of the core is applied as the resin of the shell layer, from a viewpoint of pressure fixability and prevention of deforming the toner.

From a viewpoint of low-temperature fixability and prevention of deforming the toner, the thickness of the shell layer is preferably from 140 nm to 550 nm, more preferably from 140 nm to 500 nm, and further preferably from 140 nm to 400 nm.

The thickness of the shell layer is measured by the following method. After a toner particle is embedded in an epoxy resin and the like, a thin slice is produced by cutting with a diamond knife and the like. The thin slice is observed by a transmission electron microscope (TEM) or the like, and a sectional image of plural toner particles is captured. The thickness of the shell layer is measured from the sectional image of the toner particles, at 20 places and an average value is employed. In a case where observation of the shell layer in the sectional image is difficult, observation may be performed by performing coloring.

(Characteristics and Like of Toner Particle)

The volume average particle diameter (D50v) of the toner particles is preferably from 2 μm to 10 μm and more preferably from 4 μm to 8 μm.

Various average particle diameters and various particle diameter distribution indices of the toner particles are measured by using a Coulter multisizer II (manufactured by Beckman-Coulter Corporation) and by using ISOTON-II (manufactured by Beckman-Coulter Corporation) as an electrolyte.

When measurement is performed, 0.5 mg to 50 mg of a measurement sample is added to 2 ml of a 5% aqueous solution of a surfactant (sodium alkyl benzene sulfonate is preferable) as a dispersant. The resultant of the addition is added to 100 ml to 150 ml of the electrolyte.

The electrolyte in which the sample is suspended is subjected to a dispersing treatment in an ultrasonic disperser for 1 minute. Then, particle diameter distribution of particles having a particle diameter in a range of 2 μm to 60 μm is measured by a Coulter multisizer II and by using an aperture of 100 μm as an aperture diameter. The number of particles to be subjected to sampling is 50000.

Cumulative distribution for each of a volume and a piece in a particle diameter range (channel) divided based on the measured particle diameter distribution is drawn from a small diameter side. With the cumulative distribution, a particle diameter at accumulation of 16% is defined to be a volume average particle diameter D16v and a piece average particle diameter D16p. A particle diameter at accumulation of 50% is defined to be a volume average particle diameter D50v and a cumulative average particle diameter D50p, and a particle diameter at accumulation of 84% is defined to be a volume particle diameter D84v and a piece particle diameter D84p.

The volume average particle diameter distribution index (GSDv) is calculated as $(D84v/D16v)^{1/2}$, and a piece average particle diameter distribution index (GSDp) is calculated as $(D84p/D16p)^{1/2}$, by using the above definitions.

The average circularity of the toner particles is preferably from 0.94 to 1.00 and more preferably from 0.95 to 0.98.

The average circularity of the toner particles is obtained by (equivalent circle circumference length)/(circumference length) [(circumference length of a circle having the same projection area as that of a particle image)/(circumference length of a particle projection image)]. Specifically, the average circularity has a value measured by the following method.

Firstly, toner particles as a measurement target are attracted and collected, and a flat flow is formed by using the toner particles. A particle image as a still image is taken by immediately causing strobe lightening. Then, the average circularity is obtained by a flow type particle image analyzer (FPIA-3000 manufactured by Sysmex Corporation) that performs image analysis of the particle image. The number of pieces used for sampling when the average circularity is obtained is set to be 3500.

In a case where the toner includes an external additive, the toner (developer) as a measurement target is dispersed in water including a surfactant. Then, an ultrasonic treatment is performed, and thus a toner particle in which the external additive is removed is obtained.

The toner particle (toner) shows a plastic motion with respect to pressure, even in a state of not being heated. The toner particle (toner) shows fluidity under pressing to pressure which is equal to or larger than predetermined pressure. Specifically, it is preferable that the toner particle satisfies the following formula.

$$20^\circ\ C. \geq T(1\ MPa) - T(10\ MPa) \qquad \text{Formula 1:}$$

In Formula 1, T(1 MPa) indicates a temperature (measured by using a flow tester) when viscosity at applied pressure of 1 MPa is $10^4$ Pa·s. T(10 MPa) indicates a temperature (measured by using a flow tester) when viscosity at applied pressure of 10 MPa is $10^4$ Pa·s.

A temperature difference (also referred to as "a temperature difference ΔT" below) represented by (T(1 MPa)−T(10 MPa)) is preferably equal to or greater than 20° C., more preferably equal to or greater than 40° C., further preferably equal to or greater than 60° C. If the temperature difference ΔT is equal to or greater than 20° C., a plastic motion with respect to pressure becomes sufficient and pressure fixability is improved.

The temperature difference ΔT is preferably equal to or smaller than 120° C. and more preferably equal to or smaller than 100° C. If the temperature difference ΔT is equal to or smaller than 120° C., the toner particle is not softened too much, and an occurrence of stain on a fixing member is prevented.

The value of T(10 MPa) is preferably equal to or smaller than 140° C., more preferably equal to or smaller than 130° C., and further preferably equal to or smaller than 120° C. If the value of T(10 MPa) is equal to or smaller than 140° C., excessive pressure is not applied, and pressure fixing is easily performed.

The value of T(10 MPa) is preferably equal to or greater than 60° C., more preferably equal to or greater than 65° C., and further preferably equal to or greater than 70° C. If the value of T(10 MPa) is equal to or smaller than 60° C., adhesiveness to a recording medium is improved.

The temperature difference ΔT is measured by a method using a flow tester. Examples of the flow tester include a flow tester CFT-500 manufactured by Shimadzu Seisakusho Ltd.

A specific measuring method of the temperature difference ΔT is as follows.

A sample having a pellet shape is produced by compressing and solidifying the toner particle (toner). The produced sample is set in the flow tester, and is slowly heated from 50° C. in a range of a measurement temperature, which is from 50° C. to 150° C. (temperature raising rate of +1° C./min). Then, viscosity of the sample is measured under a condition of applying predetermined extrusion pressure. The applied pressure is fixed to be 1 MPa and viscosity with respect to a temperature at 1 MPa is measured. The temperature T(1 MPa) when viscosity at the applied pressure of 1 MPa is $10^4$ Pa·s is determined from a graph of the obtained viscosity. T(10 MPa) is determined by a method similar to that for T(1 MPa) except that the applied pressure of 1 MPa is set to be 10 MPa. A difference is obtained from T(1 MPa) and T(10

MPa) which are previously obtained, and the temperature difference ΔT (T(1 MPa)−T(10 MPa)) is calculated.

[External Additive]

Examples of the external additive include an inorganic particle. Examples of the inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particle as the external additive may be treated with a hydrophobizing agent. The treatment with a hydrophobizing agent is performed by immersing inorganic particles in a hydrophobizing agent, for example. The hydrophobizing agent is not particularly limited. Examples of the hydrophobizing agent include a silane coupling agent, a silicone oil, a titanate coupling agent, and an aluminum coupling agent. The hydrophobizing agent may be singly used or may be used in combination of two kinds or more thereof.

The amount of the hydrophobizing agent is generally from 1 part by weight to 10 parts by weight with respect to 100 parts by weight of the inorganic particle, for example.

Examples of the external additive include a resin particle (resin particle of polystyrene, polymethyl methacrylate (PMMA), a melamine resin, or the like), a cleaning aid (for example, metal salt of higher fatty acid represented by zinc stearate, and particle of a fluorinated substance having a high-molecular weight).

The amount of the external additive to be externally added is preferably from 0.01% by weight to 5% by weight and more preferably from 0.01% by weight to 2.0% by weight, with respect to the toner particle, for example.

(Preparing Method of Toner)

Next, a preparing method of toner according to the exemplary embodiment will be described.

The toner according to the exemplary embodiment is obtained in a manner that a toner particle is prepared, and then an external additive is externally added to the prepared toner particle.

The toner particle may be prepared by any of a dry type preparation method (for example, kneading and pulverizing method) and a wet type preparation method (for example, aggregation and unification method, suspension polymerization method, and dissolution and suspension method). The preparation method of a toner particle is not particularly limited to the preparation methods, and a well-known preparation method is employed.

The toner particle may be obtained by an aggregation and unification method among the above methods.

Specifically, for example, in a case where a toner particle having the core-shell structure which has the above configuration is prepared by an aggregation and unification method, it is preferable that the toner particle is prepared through processes as follows.

Process of preparing a core resin particle dispersion in which a core resin particle functioning as a binder resin in the core (core resin particle dispersion preparation process);

process of preparing a shell-layer resin particle dispersion in which a shell-layer resin particle functioning as the resin of the shell layer (shell-layer resin particle dispersion preparation process);

process of forming a first aggregation particle by aggregating core resin particles (if necessary, along with other particles) in the core resin particle dispersion (if necessary, in a dispersion in which other particle dispersions such as a colorant and a release agent are mixed) (first aggregation particle forming process);

process of forming a second aggregation particle in a manner that a first aggregation particle dispersion in which first aggregation particles are dispersed and the shell-layer resin particle dispersion are mixed and aggregated so as to cause the shell-layer resin particle to adhere to the surface of the first aggregation particle (second aggregation particle forming process); and process of forming a toner particle in a manner that a second aggregation particle dispersion in which second aggregation particles are dispersed is heated and the second aggregation particles are coalesced and unified (coalescence and unification process)

A resin particle dispersion in which styrene resin particles in which plural domains of the (meth)acrylic acid ester resin are dispersed (that is, a resin particle in which the styrene resin is used as a base material and plural domains of the (meth)acrylic acid ester resin are dispersed in the base material) are dispersed is used as the core resin particle dispersion.

A resin particle dispersion in which resin particles having a glass transition temperature of 50° C. or higher are dispersed is used as the shell-layer resin particle dispersion.

Here, the oxidative polymerizable compound is added to the dispersion in any of the above processes. However, since the oxidative polymerizable compound may be included in the core, the oxidative polymerizable compound may be added to the resin particle dispersion in the core resin particle dispersion preparation process or may be added to the dispersion before aggregation, in the first aggregation particle forming process.

Details of each of the processes in the aggregation and unification method will be described below. In the following descriptions, a method of obtaining a toner particle which includes a colorant and a release agent will be described. However, the colorant and the release agent are used if necessary. Other additives other than the colorant may be used.

—Dispersion Preparation Process—

Firstly, a core resin particle dispersion, a shell-layer resin particle dispersion, a colorant particle dispersion, and a release agent particle dispersion are prepared.

Descriptions will be made below by each of the resin particle dispersions in which each type of resin particles is dispersed referring to "a resin particle dispersion".

The core resin particle dispersion is prepared as follows, for example. Firstly, styrene resin particles among core resins (binder resin of the core) are dispersed in a dispersing solvent by using a surfactant.

Examples of the dispersing solvent used in a styrene resin particle dispersion include an aqueous medium.

Examples of the aqueous medium include water such as distilled water and ion exchange water; and alcohols. The aqueous medium may be singly used or may be used in combination of two kinds or more thereof.

Examples of the surfactant include anionic surfactants of a sulfate ester salt type, a sulfonate type, a phosphoric acid ester type, a soap type, and the like; cationic surfactants of an amine salt type, a quaternary ammonium salt type, and the like; and nonionic surfactants of a polyethylene glycol type, an alkylphenol ethylene oxide adduct type, a polyhydric alcohol type, and the like. Among the above surfactants, anionic surfactants and cationic surfactants are particularly exemplified. The nonionic surfactant may be used along with the anionic surfactant or the cationic surfactant.

The surfactant may be singly used or may be used in combination of two kinds or more thereof.

Examples of a method of dispersing the styrene resin particle in the dispersing solvent include general dispersing methods using a rotation shearing type homogenizer, a ball mill having media, a sand mill, a dyno mill, and the like. In addition, the styrene resin particle may be dispersed in the dispersing solvent by a phase inversion emulsification method. The phase inversion emulsification method is a method as follows. A resin to be dispersed is dissolved in a hydrophobic organic solvent in which the resin can be dissolved. When neutralization is performed by adding a base to an organic continuous phase (O phase), water (W phase) is put into the solution, and thus phase inversion from W/O into O/W is performed and the resin is dispersed in an aqueous medium in a state of having a particulate shape.

Next, a monomer, a component such as a monomer or a polymerization initiator, which is used for synthesizing the (meth)acrylic acid ester resin is added to the dispersion in which the styrene resin particles are dispersed. Then, the dispersion is stirred. The stirring is performed for a long period, for example, in a range of 1 hour to 15 hours.

If the stirring is performed, the component such as a monomer or a polymerization initiator, which is used for synthesizing the (meth)acrylic acid ester resin is impregnated in the styrene resin particle. In this state, the monomer for synthesizing the (meth)acrylic acid ester resin is polymerized.

If the monomer is polymerized, a resin particle dispersion in which styrene resin particles in which plural domains of the (meth)acrylic acid ester resin are dispersed (that is, a resin particle in which the styrene resin is used as a base material and plural domains of the (meth)acrylic acid ester resin are dispersed in the base material) are dispersed is obtained. The resin particle dispersion is used as the core resin particle dispersion.

The volume average particle diameter of the resin particles dispersed in the core resin particle dispersion is preferably from 0.01 μm to 1 μm, more preferably from 0.08 μm to 0.8 μm, and further preferably from 0.1 μm to 0.6 μm, for example.

Regarding the volume average particle diameter of the core resin particle dispersion, particle diameter distribution obtained by measuring of a laser diffraction type particle diameter distribution measuring apparatus (for example, LA-700 manufactured by HORIBA, Ltd.) is used. Cumulative distribution for a volume in a divided particle diameter range (channel) is drawn from a small diameter side. With the cumulative distribution, a particle diameter at the volume of 50% with respect to all particles is set as a volume average particle diameter D50v. The volume average particle diameter of other particles in the dispersion is also measured in a similar manner.

The content of the resin particles included in the core resin particle dispersion is preferably from 5% by weight to 50% by weight, and more preferably from 10% by weight to 40% by weight.

A resin coating particle dispersion, a colorant dispersion, and a release agent particle dispersion are also prepared in a manner similar to that for the styrene resin obtained in the preparation process of the core resin particle dispersion. The dispersing solvent, the dispersing method, the volume average particle diameter of particles, and the content of the particles in the core resin particle dispersion are similarly applied to the colorant dispersion and the release agent particle dispersion.

—First Aggregation Particle Forming Process—

Then, the core resin particle dispersion and the colorant dispersion are mixed.

A first aggregation particle which has a diameter for the purpose of performing hetero-aggregation of a core resin particle and a colorant particle and includes the core resin particle, the colorant particle, and a release agent particle dispersion is formed in the dispersion mixture.

Specifically, for example, a flocculant is added to the dispersion mixture, pH of the dispersion mixture is adjusted to have acidity (for example, pH of 2 to 5), and if necessary, a dispersion stabilizer is added. Then, the resultant is heated to a temperature (specifically, for example, −30° C. or greater from the glass transition temperature of the core resin and −10° C. or smaller from the glass transition temperature thereof) close to the glass transition temperature of the core resin particle. Thus, particles dispersed in the dispersion mixture are aggregated, and thereby the first aggregation particle is formed.

In the first aggregation particle forming process, for example, the flocculant may be added at room temperature (for example, 25° C.), pH of the dispersion mixture may be adjusted to have acidity (for example, pH of 2 to 5), if necessary, a dispersion stabilizer may be added, and then heating may be performed, while the dispersion mixture is stirred in a rotation shearing type homogenizer.

Examples of the flocculant include a surfactant having a polarity which is reverse to that of the surfactant included in the dispersion mixture. For example, an inorganic metal salt and a bivalent or higher metal complex are exemplified. In a case where a metal complex is used as the flocculant, the amount of the flocculant to be used is reduced and charging characteristics are improved.

An additive that forms a complex or a similar bond with a metal ion of the flocculant may be used along with the flocculant. A chelating agent is suitably used as the additive.

Examples of the inorganic metal salt include a metal salt such as calcium chloride, calcium nitrate, barium chloride, magnesium chloride, zinc chloride, aluminum chloride, and aluminum sulfate; and an inorganic metal salt polymer such as polyaluminum chloride, polyaluminum hydroxide, and calcium poly sulfide.

A water-soluble chelating agent may be used as the chelating agent. Examples of the chelating agent include oxycarboxylic acid such as tartaric acid, citric acid, and gluconic acid; and amino carboxylic acid such as iminodiacetic acid (IDA), nitrilotriacetic acid (NTA), and ethylenediamine tetraacetic acid (EDTA).

The amount of the chelating agent to be added is, for example, preferably from 0.01 parts by weight to 5.0 parts by weight with respect to 100 parts by weight of the resin particles, and more preferably 0.1 parts by weight or greater and smaller than 3.0 parts by weight.

—Second Aggregation Particle Forming Process—

After the first aggregation particle dispersion in which first aggregation particles are dispersed is obtained, the first aggregation particle dispersion and the shell-layer resin particle dispersion are further mixed with each other.

A second aggregation particle which has a diameter which is a close to a toner particle diameter for the purpose of performing hetero-aggregation so as to cause the shell-layer resin particle to adhere to the surface of the first aggregation particle is formed in the dispersion mixture.

Specifically, for example, in the first aggregation particle forming process, when the diameter of the first aggregation particle reaches an aimed particle diameter, the shell-layer resin particle dispersion is mixed in the first aggregation particle dispersion. Then, the dispersion mixture is heated at a temperature which is equal to or lower than the glass transition temperature of the shell-layer resin particle, and pH of the dispersion mixture is adjusted to be in, for example, a range of about 6.5 to 8.5. Thus, the progress of the aggregation is stopped.

Accordingly, the second aggregation particle aggregated so as to cause the shell-layer resin particle and a release agent particle to adhere to the surface of the first aggregation particle is obtained.

—Coalesce•Unification Process—

Then, the second aggregation particle dispersion in which second aggregation particles are dispersed is heated to a temperature which is equal to or higher than the glass transition temperature of the shell-layer resin (for example, being equal to or higher than a temperature which is higher than the glass transition temperature of the shell-layer resin by 10° C. to 50° C.) so as to coalesce•unify the second aggregation particles. Thereby, a toner particle is formed.

The toner particle is obtained through the above-described processes.

The toner particle may be prepared through processes as follows: process of forming a third aggregation particle in a manner that, after the second aggregation particle dispersion in which second aggregation particles are dispersed, the second aggregation particle dispersion and the resin particle dispersion in which resin particles having a glass transition temperature of 50° C. or higher are dispersed are further mixed, and aggregation is performed so as to cause the resin particle to further adhere to the surface of the second aggregation particle; and process of forming a toner particle in a manner that a third aggregation particle dispersion in which third aggregation particles are dispersed is heated and the third aggregation particles are coalesced and unified.

After the coalescing•unifying process is ended, the toner particle formed in the solution is subjected to a known cleaning process, a known solid-liquid separation process, and a known dry process. Thus, a toner particle in a state of being dried is obtained.

In the cleaning process, substitution cleaning by ion exchange water may be sufficiently performed from a point of chargeability. The solid-liquid separation process is not particularly limited. However, from a point of productivity, suction filtration, pressing filtration, or the like may be performed. Regarding the dry process, the method is also not particularly limited. However, from a point of productivity, freeze drying, air stream drying, fluidized drying, vibration type fluidized drying, or the like may be performed.

The toner according to the exemplary embodiment is prepared, for example, by adding and mixing an external additive to a dried toner particle. The mixing may be performed, for example, by a V blender, a HENSCHEL mixer, a LOEDIGE mixer, or the like. Further, if necessary, a coarse particle of the toner may be removed by using a vibration classifier, a wind classifier, or the like.

<Electrostatic Charge Image Developer>

An electrostatic charge image developer according to the exemplary embodiment includes at least the toner according to the exemplary embodiment.

The electrostatic charge image developer according to the exemplary embodiment may be a single-component developer which includes only the toner according to the exemplary embodiment, or may be a two-component developer in which the toner and a carrier are mixed.

The carrier is not particularly limited, and known carrier is exemplified. Examples of the carrier include a coated carrier in which a surface of a core formed from magnetic particles is coated with a coating resin; a magnetic-particle dispersion type carrier in which magnetic particles are dispersed and mixed in a matrix resin; and a resin-impregnated type carrier in which a resin is impregnated in a porous magnetic particle.

The magnetic-particle dispersion type carrier and the resin-impregnated type carrier may be carriers in which a constituent particle of the carrier is used as a core and the core is coated with a coating resin.

Examples of the magnetic particle include magnetic metal such as iron, nickel, and cobalt and a magnetic oxide such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid ester copolymers, straight silicone resins configured to include an organosiloxane bond or modified products thereof, fluororesins, polyester, polycarbonate, phenolic resins, and epoxy resins.

The coating resin and the matrix resin may include other additives such as a conductive particle.

Examples of the conductive particle include particles of metal such as gold, silver, and copper, carbon black, titanium oxide, zinc oxide, tin oxide, barium sulfate, aluminum borate, potassium titanate, and the like.

Here, when the surface of the core is coated with the coating resin, a method of performing coating with a solution for forming a shell layer, in which the coating resin and, if necessary, various additives are dissolved in a suitable solvent is exemplified. The solvent is not particularly limited, and may be selected based on a coating resin to be used, application suitability, and the like.

Specific examples of a resin coating method include a dipping method of dipping a core in a solution for forming a shell layer, a spray method of spraying a solution for forming a shell layer onto the surface of a core, a fluidized bed method of spraying a solution for forming a shell layer in a state where a core is caused to float by a flowing air, and a kneader and coater method of mixing a core of a carrier with a solution for forming a shell layer in a kneader and coater and of removing a solvent.

In the two-component developer, a mixing ratio (weight ratio) of the toner and the carrier is preferably from 1:100 to 30:100 and more preferably from 3:100 to 20:100, in a form of toner: carrier.

<Image Forming Apparatus/Image Forming Method>

An image forming apparatus/image forming method according to the exemplary embodiment will be described.

The image forming apparatus according to the exemplary embodiment includes an image holding member, a charging section, an electrostatic charge image forming section, a developing section, a transferring section, and a fixing section. The charging section charges the surface of the image holding member. The electrostatic charge image forming section forms an electrostatic charge image on the charged surface of the image holding member. The developing section accommodates an electrostatic charge image developer and develops an electrostatic charge image formed on the surface of the image holding member by using the electrostatic charge image developer, so as to form a toner image. The transferring section transfers the toner image formed on the surface of the image holding member onto the surface of a recording medium. The fixing section fixes the toner image transferred onto the surface of the recording medium. The electrostatic charge image developer according to the exemplary embodiment is applied as the above electrostatic charge image developer.

In the image forming apparatus according to the exemplary embodiment, an image forming method (image forming method according to the exemplary embodiment) is performed. The image forming method includes a charging process of charging the surface of an image holding member, an electrostatic charge image forming process of forming an electrostatic charge image on the charged surface of the image holding member, a developing process of developing the electrostatic charge image formed on the surface of the image holding member by using the electrostatic charge image developer according to the exemplary embodiment, so as to form a toner image, a transferring process of transferring the toner image formed on the surface of the image holding member onto the surface of a recording medium, and a fixing process of fixing the toner image transferred onto the surface of the recording medium.

Here, in the image forming apparatus according to the exemplary embodiment, a section that fixes a toner image formed by a pressure fixation toner onto a recording medium by pressure between a pair of fixing members (roll/roll or belt/roll) is exemplified as the fixing section. The fixing section may additionally include a heating source for heating the toner image formed by the pressure fixation toner, in order to improve pressure fixability. The fixing section may be a device that performs fixing by only pressure without the heating source (that is, without heating).

The heating source being not provided (that is, heating is not performed) does not mean that an occurrence of a situation in which a temperature in the apparatus is increased to be equal to or higher than an environmental temperature by heat and the like which are generated by power in a certain section other than the fixing section is prevented.

In the fixing section, fixing pressure is preferably from 1.5 MPa to 10 MPa, more preferably from 2 MPa to 8 MPa, and further preferably from 3 MPa to 7 MPa.

If the fixing pressure is equal to or larger than 1.5 MPa, sufficient fixability is easily obtained. If the fixing pressure is equal to or smaller than 10 MPa, an occurrence of image staining, fixing roll staining, and paper jamming, and curling of a recording medium after fixing (phenomenon in which the recording medium is bent) which occur by an occurrence of an offset (phenomenon in which a portion of a toner image is moved to a fixing member) and the like are easily prevented.

The fixing pressure means the maximum fixing pressure when press fixing is performed.

Here, pressure distribution between the pair of fixing members may be measured by a commercial pressure distribution measurement sensor. Specifically, the pressure distribution may be measured, for example, by a roller pressure measurement system manufactured by Kamata Industry Co., Ltd. The maximum pressure when press fixing is performed indicates the maximum value when pressure is changed from an entrance to an exit from a contact portion (nip) of the pair of fixing members in a recording medium traveling direction.

In a case where heating is also performed with fixing, a fixing temperature is preferably from 15° C. to 50° C., more preferably from 15° C. to 45° C., and further preferably from 15° C. to 40° C. The above range is preferable because, if the fixing temperature is in the above range, it is possible to obtain favorable fixability.

For example, a known fixing member in the related art is appropriately selected as the fixing member, in a range in which the fixing pressure in the above range may be applied to a toner image.

For example, a fixing roll in which a resin layer of a fluororesin (for example, TEFLON (registered trademark)), a silicone resin, a perfluoroalkylate resin, or the like is applied onto a cylindrical core bar is exemplified as a fixing member on a side of coming into contact with a toner image, among the fixing members. A fixing roll having a base material made of SUS is suitable for obtaining high fixing pressure.

As the image forming apparatus according to the exemplary embodiment, well-known image forming apparatuses as follows are applied: a direct transfer type apparatus that directly transfers a toner image formed on the surface of an image holding member onto a recording medium; an intermediate transfer type apparatus that primarily transfers a toner image formed on the surface of the image holding member onto a surface of an intermediate transfer member, and secondarily transfers the toner image transferred onto the surface of the intermediate transfer member, onto the surface of a recording medium; an apparatus including a cleaning section that cleans the surface of an image holding member after a toner image is transferred and before charging is performed; and an apparatus including an erasing section that performs erasing by irradiating the surface of an image holding member before charging, with erasing light after the toner image has been transferred.

In a case of the intermediate transfer type apparatus, the transferring section has a configuration in which an intermediate transfer member on which a toner image is transferred onto a surface, a primary transferring section that primarily transfers the toner image formed on the surface of an image holding member onto the surface of the intermediate transfer member, and a secondary transferring section that secondarily transfers the toner image transferred onto the surface of the intermediate transfer member, onto the surface of a recording medium.

Here, examples of the cleaning section include a section that cleans the surface of the image holding member by using a cleaning blade, a cleaning brush, or the like.

However, when cleaning is performed by a cleaning blade, a phenomenon in which a pressure fixation toner remaining on the surface of the image holding member is plasticized by pressure of the cleaning blade, and thus adheres to the surface of the image holding member so as to have a film shape may occur. Therefore, it is preferable that the cleaning section is a section that cleans the surface of the image holding member by using a cleaning brush having small stress on the pressure fixation toner.

As the cleaning brush, a fixed brush such as a brush and a rotatable brush in which fiber is arranged to have a cylindrical shape are provided. A conductive brush that uses conductive fiber and electrostatically removes a toner by applying a voltage is also provided.

In the image forming apparatus according to the exemplary embodiment, for example, a part including the developing section may have a cartridge structure (process cartridge) which is detachable from the image forming apparatus. For example, a process cartridge including a developing section that accommodates the electrostatic charge image developer according to the exemplary embodiment is suitably used as the process cartridge.

An example of the image forming apparatus according to the exemplary embodiment will be described below. However, the image forming apparatus is not limited thereto. The main portions illustrated in the drawings will be described and descriptions of other portions will be omitted.

FIG. 1 is a schematic configuration diagram illustrating the image forming apparatus according to the exemplary embodiment.

The image forming apparatus illustrated in FIG. 1 includes first to fourth image forming units 10Y, 10M, 10C, and 10K (image forming section). The image forming units are an electrophotographic type and output images of colors of yellow (Y), magenta (M), cyan (C) and black (K), based on image data in which colors are separated. The image forming units (may be simply referred to as "units" below) 10Y, 10M, 10C, and 10K are provided in parallel to each other so as to be separate from each other at a predetermined distance in a horizontal direction. The units 10Y, 10M, 10C, and 10K may be process cartridges which are detachable from the image forming apparatus.

An intermediate transfer belt 20 as an intermediate transfer member is provided over each of the units 10Y, 10M, 10C, and 10K in FIG. 1, so as to be extended through the units. The intermediate transfer belt 20 is provided to be wound around a driving roll 22 and a support roll 24 which are disposed to be separate from each other in a direction from the left to the right in FIG. 1, with the inner surface thereof being in contact with the rolls 22 and 24. Thus, the intermediate transfer belt 20 travels in a direction from the first unit 10Y to the fourth unit 10K. A force is applied to the support roll 24 in a direction separated from the driving roll 22 by a spring (not illustrated) and the like, and tension is applied to the intermediate transfer belt 20 which is wound around the support roll 24 and the driving roll 22. An intermediate transfer member cleaning device 30 is provided on the surface of the intermediate transfer belt 20 on the image holding member side, so as to face the driving roll 22.

A toner including toners of four colors (yellow, magenta, cyan, and black), which are respectively stored in toner cartridges 8Y, 8M, 8C, and 8K is supplied to each of developing devices (developing sections) 4Y, 4M, 4C, and 4K of the units 10Y, 10M, 10C, and 10K.

The first to fourth units 10Y, 10M, 10C, and 10K have the equivalent configuration. Thus, here, the first unit 10Y that is disposed on an upstream side in an intermediate transfer belt traveling direction and forms a yellow image will be described as the representative. Components which are equivalent to those in the first unit 10Y are denoted by reference marks having magenta (M), cyan (C), and black (K) instead of yellow (Y). Thus, descriptions of the second to fourth units 10M, 10C, and 10K will be not repeated.

The first unit 10Y includes a photoconductor 1Y functioning as an image holding member. A charging roll (an example of the charging section) 2Y, an exposure device (an example of the electrostatic charge image forming section) 3, a developing device (an example of the developing section) 4Y, a primary transfer roll 5Y (an example of the primary transferring section), and a photoconductor cleaning device (an example of the cleaning section) 6Y are sequentially arranged around the photoconductor 1Y. The charging roll 2Y charges the surface of the photoconductor 1Y to have a predetermined potential. The exposure device 3 exposes the charged surface with a laser beam 3Y based on an image signal in which colors are separated, so as to form an electrostatic charge image. The developing device 4Y develops the electrostatic charge image by supplying a charged toner to the electrostatic charge image. The primary transfer roll 5Y transfers the developed toner image onto the intermediate transfer belt 20. The photoconductor cleaning device 6Y removes the toner remaining on the surface of the photoconductor 1Y, after primary transfer is performed.

The primary transfer roll 5Y is disposed on an inner side of the intermediate transfer belt 20 and is provided at a position which faces the photoconductor 1Y. Further, a bias power source (not illustrated) that applies a primary transfer bias is connected to each of primary transfer rolls 5Y, 5M, 5C, and 5K. Each bias power source is controlled by a control unit (not illustrated), so as to change a transfer bias which is applied to each of the primary transfer rolls.

An operation of forming a yellow image in the first unit 10Y will be described below.

Firstly, ahead of the operation, the surface of the photoconductor 1Y is charged by the charging roll 2Y, so as to have a potential of −600 V to −800 V.

The photoconductor 1Y is formed in a manner that a photosensitive layer is stacked on a conductive (for example, volume resistivity at 20° C. is equal to or smaller than $1-10^{-6}$ Ωcm) base member. Although the photosensitive layer generally has high resistance (resistance of a general resin), the photosensitive layer has properties in which specific resistance at a portion irradiated with the laser beam is changed if irradiation with the laser beam 3Y is performed. The laser beam 3Y is output to the charged surface of the photoconductor 1Y via an exposure device 3, in accordance with image data for yellow, which is delivered from the control unit (not illustrated). The photosensitive layer on the surface of the photoconductor 1Y is irradiated with the laser beam 3Y, and thus an electrostatic charge image having a yellow image pattern is formed on the surface of the photoconductor 1Y.

The electrostatic charge image is an image which is formed on the surface of the photoconductor 1Y by charging. The electrostatic charge image is a so-called negative latent image which is formed in a manner that specific resistance at an irradiated portion of the photosensitive layer is decreased by the laser beam 3Y, electric charges which are charged on the surface of the photoconductor 1Y flow, and electric charges at a portion of the photosensitive layer, which is not irradiated with the laser beam 3Y remains.

The electrostatic charge image formed on the photoconductor 1Y is rotated to a position a predetermined developing position, with traveling of the photoconductor 1Y. The electrostatic charge image on the photoconductor 1Y is changed to a visible image (developed image) as a toner image, at this developing position by the developing device 4Y.

An electrostatic charge image developer which includes, for example, at least a yellow toner and a carrier is accommodated in the developing device 4Y. The yellow toner is charged by friction which occurs by being stirred in the developing device 4Y. The yellow toner has electric charges having the same polarity (negative polarity) as that of electric charges which are charged on the photoconductor 1Y, and thus is held on a developer roll (an example of a developer holding member). If the surface of the photoconductor 1Y passes through the developing device 4Y, the yellow toner electrostatically adheres to a latent image portion erased on the surface of the photoconductor 1Y. Thus, a latent image is developed by the yellow toner. The photoconductor 1Y on which a yellow toner image is formed continuously travels at a predetermined speed, and the toner image developed on the photoconductor 1Y is transported to a predetermined primary transfer position.

If the yellow toner image on the photoconductor 1Y is transported to the primary transfer position, a primary transfer bias is applied to the primary transfer roll 5Y, and an electrostatic force directed from the photoconductor 1Y toward the primary transfer roll 5Y is applied to the toner image. Thus, the toner image on the photoconductor 1Y is transferred onto the intermediate transfer belt 20. The transfer bias applied at this time has (+) polarity which is reverse to (−) polarity of the toner. For example, in the first unit 10Y, the transfer bias is controlled to be +10 μA by the control unit (not illustrated).

The toner remaining on the photoconductor 1Y is removed and collected by the photoconductor cleaning device 6Y.

Primary transfer biases applied to the primary transfer rolls 5M, 5C, and 5K in the units subsequent to the second unit 10M are also controlled based on the control in the first unit.

In this manner, the intermediate transfer belt 20 onto which the yellow toner image is transferred in the first unit 10Y is sequentially transported through the second to fourth units 10M, 10C, and 10K, and thus multiple transfer is performed by overlapping toner image of colors with each other.

The intermediate transfer belt 20 onto which multiple transfer of toner images of four colors is performed through the first to fourth units reaches a secondary transfer unit. The secondary transfer unit is configured by the intermediate transfer belt 20, the support roll 24 which comes into contact with the inner surface of the intermediate transfer belt, and a secondary transfer roll (an example of the secondary transferring section) 26. The secondary transfer roll 26 is disposed on an image holding surface side of the intermediate transfer belt 20. A recording sheet (an example of the recording medium) P is fed to a gap at which the secondary transfer roll 26 and the intermediate transfer belt 20 are in contact with each other. The feeding is performed at a predetermined timing via a feeding mechanism. Then, a secondary transfer bias is applied to the support roll 24. The transfer bias applied at this time has (−) polarity which is the same as (−) polarity of the toner. An electrostatic force directed from the intermediate transfer belt 20 toward the recording sheet P is applied to the toner image. Thus, the toner image on the intermediate transfer belt 20 is transferred onto the recording sheet P. The secondary transfer bias at this time is determined depending on resistance detected by a resistance detection section (not illustrated) that detects resistance of the secondary transfer unit. The secondary transfer bias is voltage-controlled.

Then, the recording sheet P is fed to a nip portion between the pair of fixing rolls in a fixing device (an example of the fixing section) 28. The toner image is fixed onto the recording sheet P, and thus a fixed image is formed.

Examples of the recording sheet P onto the toner image is transferred include plain paper used in a copying machine, a printer, and the like of an electrostatic system. Examples of the recording medium also include an OHP sheet in addition to the recording sheet P.

In order to further improve smoothness of a surface of an image after fixing, it is preferable that the surface of the recording sheet P is also smooth. For example, coated paper obtained by coating the surface of plain paper with a resin or the like, art paper for printing, and the like are suitably used.

The recording sheet P on which fixing of a color image is completed is sent out to an exit unit. Then, a series of a color image forming operation is ended.

<Process Cartridge/Toner Cartridge>

The process cartridge according to the exemplary embodiment will be described.

The process cartridge according to the exemplary embodiment is a process cartridge which is detachable from an image forming apparatus and includes the developing section that accommodates the electrostatic charge image developer according to the exemplary embodiment, and develops an electrostatic charge image formed on the surface of the image holding member by using the electrostatic charge image developer, so as to form a toner image.

The process cartridge according to the exemplary embodiment is not limited to the above configuration. For example, the process cartridge may include a developing device and, if necessary, at least one selected from other sections such as the image holding member, the charging section, the electrostatic charge image forming section, and the transferring section.

An example of the process cartridge according to the exemplary embodiment will be described. However, it is not limited thereto. The main portions illustrated in the drawings will be described and descriptions of other portions will be omitted.

Figure 2:
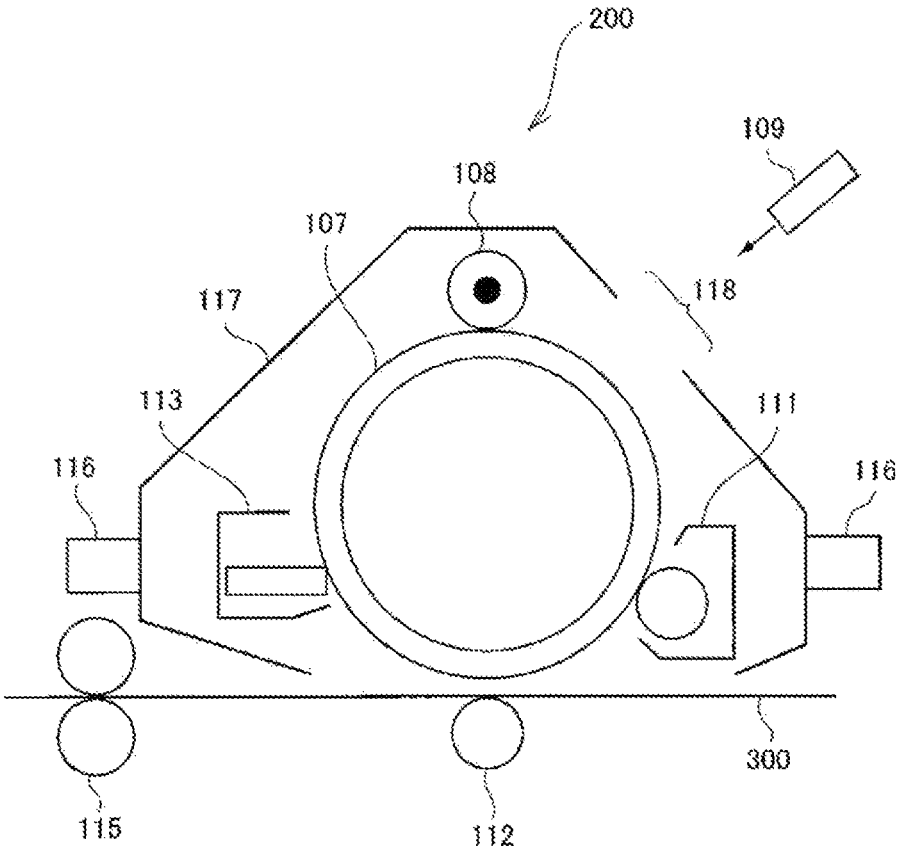
FIG. 2 is a schematic configuration diagram illustrating an example of a process cartridge according to the exemplary embodiment.

FIG. 2 is a schematic configuration diagram illustrating the process cartridge according to the exemplary embodiment.

A process cartridge 200 illustrated in FIG. 2 has a configuration in which a photoconductor 107 (an example of the image holding member), a charging roll 108 provided around the photoconductor 107 (an example of the charging section), a developing device 111 (an example of the developing section), and a photoconductor cleaning device 113 (an example of the cleaning section) are integrally assembled and held by a housing 117 in which a mounting rail 116 and an opening portion 118 for exposure are provided, and thus has a form of a cartridge.

In FIG. 2, the reference mark of 109 indicates an exposure device (an example of the electrostatic charge image forming section), and the reference mark of 112 indicates a transfer device (an example of the transferring section). The reference mark of 115 indicates a fixing device (an example of the fixing section), and the reference mark of 300 indicates a recording sheet (an example of the recording medium).

Next, the toner cartridge according to the exemplary embodiment will be described.

The toner cartridge according to the exemplary embodiment is a toner cartridge that accommodates the toner according to the exemplary embodiment and is detachable from the image forming apparatus. The toner cartridge accommodates a replenishment toner which is used for being supplied to the developing section in the image forming apparatus.

The image forming apparatus illustrated in FIG. 1 is an image forming apparatus having a configuration in which toner cartridges 8Y, 8M, 8C, and 8K are detachable. The developing devices 4Y, 4M, 4C, and 4K are respectively connected to the toner cartridges corresponding to the developing devices of the corresponding colors, by a toner supply tube (not illustrated). In a case where the amount of the toner accommodated in the toner cartridge is small, the toner cartridge is replaced.

EXAMPLES

The exemplary embodiment will be more specifically described in detail by using examples and comparative examples. The exemplary embodiment is not limited to any of the examples. "A part" and "%" indicating an amount is based on the weight so long as particular statements are not made.

<Preparation of Core Resin Particle>

(Preparation of Core Resin Particle Dispersion (A1))

Styrene: 450 parts n-butyl acrylate: 135 parts

Acrylic acid: 12 parts

Dodecane thiol: 9 parts

A solution is prepared by mixing and dissolving the components.

10 parts of an anionic surfactant (DOWFAX2A1 manufactured by Dow Chemical Company) are dissolved in 250 parts of ion exchange water. The solution is added and is dispersed in a flask, so as to be emulsified (monomer emulsification liquid A).

Further, 1 part of the same anionic surfactant (DOWFAX2A1 manufactured by Dow Chemical Company) is dissolved in 555 parts of ion exchange water and the resultant is put into a polymerization flask. A reflux tube is installed in the polymerization flask. Then, the polymerization flask is heated up to 75° C. in a water bath while nitrogen is injected and stirring is slowly performed. Then, the polymerization flask is held. 9 parts of ammonium persulfate are dissolved in 43 parts of ion exchange water. The resultant is dropped into the polymerization flask by a metering pump for 20 minutes. Then, the monomer emulsification liquid A is dropped by using a metering pump for 200 minutes.

Then, while stirring continues, the polymerization flask is held at 75° C. for 3 hours. Then, polymerization at a first stage is ended. Thus, a precursor of a core resin particle dispersion (A1), in which the volume average particle diameter of particles is 190 nm, the glass transition temperature thereof is 53° C., and the weight average molecular weight thereof is 33,000 is obtained.

Then, after the temperature is decreased to room temperature, 600 parts of 2-ethylhexyl acrylate and 850 parts of ion exchange water are added to the polymerization flask. Then, the resultant is slowly stirred for 2 hours. Then, while stirring continues, the temperature is raised to 70° C. 4.5 parts of ammonium persulfate and 110 parts of ion exchange water are dropped by using a metering pump form 20 minutes. Then, while stirring continues, the resultant is held for 3 hours, and then polymerization is ended. The core resin particle dispersion (A1) in which the volume average particle diameter is 260 nm, the weight average molecular weight is 200,000, and the solid content is 33% is obtained through the above-described processes.

Resin particles of the obtained core resin particle dispersion are dried, and a sample obtained by embedding the dried resin particle in an epoxy resin is produced. The sample is cut by a diamond knife, and thus a sectional slice of the resin particle is provided. A cut surface of the sample is colored in steam of ruthenium tetroxide, and then is confirmed by observation of a transmission electron microscope. As a result obtained by observing a section of the resin particle, it is confirmed that the resin particle has a configuration in which plural domains of a low-Tg (meth) acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −70° C. In addition, glass transition occurring by the high-Tg styrene resin is observed at 53° C. (glass transition temperature difference: 123° C.).

(Preparation of Core Resin Particle Dispersion (A2))

A core resin particle dispersion (A2) in which the volume average particle diameter is 265 nm and the solid content is 33% is obtained in a manner similar to that for the core resin particle dispersion (A1) except that 600 parts of n-butyl acrylate are used instead of 600 parts of 2-ethylhexyl acrylate.

Regarding resin particles of the obtained core resin particle dispersion, when a section of the resin particle is observed in a manner similar to that for the core resin particle dispersion (A1), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −55° C. In addition, glass transition occurring by the high-Tg styrene resin is observed at 53° C. (glass transition temperature difference: 108° C.).

(Preparation of Core Resin Particle Dispersion (A3))

A core resin particle dispersion (A3) in which the volume average particle diameter is 268 nm and the solid content is 33% is obtained in a manner similar to that for the core resin particle dispersion (A1) except that 600 parts of ethyl acrylate are used instead of 600 parts of 2-ethylhexyl acrylate.

Regarding resin particles of the obtained core resin particle dispersion, when a section of the resin particle is observed in a manner similar to that for the core resin particle dispersion (A1), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −20° C. In addition, glass transition occurring by the high-Tg styrene resin is observed at 53° C. (glass transition temperature difference: 73° C.).

(Preparation of Core Resin Particle Dispersion (A4))

Styrene: 450 parts n-butyl acrylate: 135 parts

Acrylic acid: 12 parts

Dodecane thiol: 9 parts

Allyl methacrylate: 20 parts

A solution is prepared by mixing and dissolving the components.

10 parts of an anionic surfactant (DOWFAX2A1 manufactured by Dow Chemical Company) are dissolved in 250 parts of ion exchange water. The solution is added and is dispersed in a flask, so as to be emulsified (monomer emulsification liquid A). Further, 1 part of the same anionic surfactant (DOWFAX2A1 manufactured by Dow Chemical Company) is dissolved in 555 parts of ion exchange water and the resultant is put into a polymerization flask. A reflux tube is installed in the polymerization flask. Then, the polymerization flask is heated up to 75° C. in a water bath while nitrogen is injected and stirring is slowly performed. Then, the polymerization flask is held. 9 parts of ammonium persulfate are dissolved in 43 parts of ion exchange water. The resultant is dropped into the polymerization flask by a metering pump for 20 minutes. Then, the monomer emulsification liquid A is dropped by using a metering pump for 200 minutes.

Then, while stirring continues, the polymerization flask is held at 75° C. for 3 hours. Then, polymerization at a first stage is ended. Thus, a precursor of a core resin particle dispersion (A4), in which the volume average particle diameter of particles is 190 nm, the glass transition temperature thereof is 58° C., and the weight average molecular weight thereof is 33,000 is obtained.

Then, after the temperature is decreased to room temperature, 600 parts of 2-ethylhexyl acrylate and 850 parts of ion exchange water are added to the polymerization flask. Then, the resultant is slowly stirred for 2 hours. Then, while stirring continues, the temperature is raised to 70° C. 4.5 parts of ammonium persulfate and 110 parts of ion exchange water are dropped by using a metering pump form 20 minutes. Then, while stirring continues, the resultant is held for 3 hours, and then polymerization is ended. The core resin particle dispersion (A4) in which the volume average particle diameter is 260 nm, the weight average molecular weight is 180,000, and the solid content is 33% is obtained through the above-described processes.

Regarding resin particles of the obtained core resin particle dispersion, when a section of the resin particle is observed in a manner similar to that for the core resin particle dispersion (A1), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −70° C. In addition, glass transition occurring by the high-Tg styrene resin is observed at 56° C. (glass transition temperature difference: 126° C.).

(Preparation of Core Resin Particle Dispersion (A5))

A core resin particle dispersion (A5) in which the volume average particle diameter is 250 nm and the solid content is 33% is obtained in a manner similar to that for the core resin particle dispersion (A1) except that 600 parts of 2-ethylhexyl acrylate and 20 parts of allyl methacrylate are used instead of 600 parts of 2-ethylhexyl acrylate.

Regarding resin particles of the obtained core resin particle dispersion, when a section of the resin particle is observed in a manner similar to that for the core resin particle dispersion (A1), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −50° C. In addition, glass transition occurring by the high-Tg styrene resin is observed at 53° C. (glass transition temperature difference: 103° C.).

<Preparation of Shell Resin Particle Dispersion>

(Preparation of Shell Resin Particle Dispersion (B1))

Styrene: 450 parts
n-butyl acrylate: 135 parts
Allyl methacrylate: 18 parts
Acrylic acid: 12 parts
Dodecane thiol: 9 parts A solution is prepared by mixing and dissolving the components.

10 parts of an anionic surfactant (DOWFAX2A1 manufactured by Dow Chemical Company) are dissolved in 250 parts of ion exchange water. The solution is added and is dispersed in a flask, so as to be emulsified (monomer emulsification liquid A).

Further, 1 part of the same anionic surfactant (DOWFAX2A1 manufactured by Dow Chemical Company) is dissolved in 555 parts of ion exchange water and the resultant is put into a polymerization flask. A reflux tube is installed in the polymerization flask. Then, the polymerization flask is heated up to 75° C. in a water bath while nitrogen is injected and stirring is slowly performed. Then, the polymerization flask is held. 9 parts of ammonium persulfate are dissolved in 43 parts of ion exchange water. The resultant is dropped into the polymerization flask by a metering pump for 20 minutes. Then, the monomer emulsification liquid A is dropped by using a metering pump for 200 minutes.

Then, while stirring continues, the polymerization flask is held at 75° C. for 3 hours. Then, polymerization at a first stage is ended. Thus, a resin coating particle dispersion (B1) in which the volume average particle diameter of particles is 190 nm, the glass transition temperature thereof is 53° C., the weight average molecular weight thereof is 33,000, and the solid content is 42% is obtained.

(Preparation of Resin Coating Particle Dispersion (B2))

Styrene: 450 parts
n-butyl acrylate: 90 parts
Acrylic acid: 12 parts
Dodecane thiol: 9 parts A solution is prepared by mixing and dissolving the components.

10 parts of an anionic surfactant (DOWFAX2A1 manufactured by Dow Chemical Company) are dissolved in 250 parts of ion exchange water. The solution is added and is dispersed in a flask, so as to be emulsified (monomer emulsification liquid A).

Further, 1 part of the same anionic surfactant (DOWFAX2A1 manufactured by Dow Chemical Company) is dissolved in 555 parts of ion exchange water and the resultant is put into a polymerization flask. A reflux tube is installed in the polymerization flask. Then, the polymerization flask is heated up to 75° C. in a water bath while nitrogen is injected and stirring is slowly performed. Then, the polymerization flask is held. 9 parts of ammonium persulfate are dissolved in 43 parts of ion exchange water. The resultant is dropped into the polymerization flask by a metering pump for 20 minutes. Then, the monomer emulsification liquid A is dropped by using a metering pump for 200 minutes.

Then, while stirring continues, the polymerization flask is held at 75° C. for 3 hours. Then, polymerization at a first stage is ended. Thus, a resin coating particle dispersion (B2) in which the volume average particle diameter of particles is 190 nm, the glass transition temperature thereof is 85° C., the weight average molecular weight thereof is 36,000, and the solid content is 42% is obtained.

(Preparation of Resin Coating Particle Dispersion (B3))

A resin coating particle dispersion (B3) in which the volume average particle diameter is 200 nm, the glass transition temperature is 62° C., the weight average molecular weight Mw is 38000, and the solid content is 42% is obtained in a manner similar to that for the resin coating particle dispersion (B1) except that 37 parts of allyl methacrylate are used.

(Preparation of Resin Coating Particle Dispersion (B4))

Styrene: 450 parts n-butyl acrylate: 150 parts

Acrylic acid: 12 parts

Dodecane thiol: 9 parts

A solution is prepared by mixing and dissolving the components.

10 parts of an anionic surfactant (DOWFAX2A1 manufactured by Dow Chemical Company) are dissolved in 250 parts of ion exchange water. The solution is added and is dispersed in a flask, so as to be emulsified (monomer emulsification liquid A).

Further, 1 part of the same anionic surfactant (DOWFAX2A1 manufactured by Dow Chemical Company) is dissolved in 555 parts of ion exchange water and the resultant is put into a polymerization flask. A reflux tube is installed in the polymerization flask. Then, the polymerization flask is heated up to 75° C. in a water bath while nitrogen is injected and stirring is slowly performed. Then, the polymerization flask is held. 9 parts of ammonium persulfate are dissolved in 43 parts of ion exchange water. The resultant is dropped into the polymerization flask by a metering pump for 20 minutes. Then, the monomer emulsification liquid A is dropped by using a metering pump for 200 minutes.

Then, while stirring continues, the polymerization flask is held at 75° C. for 3 hours. Then, polymerization at a first stage is ended. Thus, a resin coating particle dispersion (B4) in which the volume average particle diameter of particles is 190 nm, the glass transition temperature thereof is 49° C., the weight average molecular weight thereof is 31,000, and the solid content is 40% is obtained.

<Preparation of Colorant Particle Dispersion>

Cyan pigment: 1000 parts (Pigment Blue 15:3 (copper phthalocyanine) manufactured by Dainichiseika Color & Chemicals Mfg. Co., Ltd.)

Anionic surfactant: 15 parts (NEOGEN R manufactured by DKS Co. Ltd.)

Ion exchange water: 9000 parts

The components are mixed, and the mixture is dispersed by using an ultimizer as a high-pressure impact type dispersing machine, (HJP30006 manufactured by Sugino Machine Limited for 1 hour. Then, a colorant (cyan pigment) is dispersed, and thereby a colorant particle dispersion is prepared. In the colorant particle dispersion, the volume average particle diameter of the colorant (cyan pigment) is 160 nm and the solid concentration is 20%.

<Preparation of Release Agent Particle Dispersion>

Polyethylene wax: 50 parts (PW725 manufactured by TOYO ADL Corp., melting temperature of 100° C.)

Anionic surfactant: 0.5 parts (NEOGEN RK manufactured by DKS Co. Ltd.)

Ion exchange water: 200 parts

The components are mixed and the mixture is heated to 95° C. Then, the mixture is dispersed by using a homogenizer (ULTRA-TURRAX T50 manufactured by IKA Corp.). Then, a dispersing treatment is performed in a Manton-Gaulin high-pressure homogenizer (manufactured by Gaulin Corp.). Then, a release agent is dispersed, and thereby a release agent particle dispersion (solid concentration: 20%) is prepared. The volume average particle diameter of the release agent is 230 nm.

Example 1

Core resin particle dispersion (A1): 504 parts

Colorant particle dispersion: 63 parts

Ion exchange water: 710 parts

Anionic surfactant: 1 part (Dowfax2A1 manufactured by Dow Chemical Company)

Oxidative polymerizable compound (linseed oil): 25 parts

The components as materials for forming a core are put into a reaction vessel which has a volume of 3 liters and includes a thermometer, a pH meter, and a stirrer. 1.0% nitric acid is added at a temperature of 25° C., and thus pH is adjusted to 3.0. Then, while being dispersed at 5,000 rpm in a homogenizer (ULTRA TURRAX T50 manufactured by IKA Japan Corp.), 23 parts of a prepared aluminum sulfate aqueous solution are added to the reaction vessel, and are dispersed for 6 minutes.

Then, a stirrer and a Mantle heater are installed in the reaction vessel. While the number of rotations of the stirrer is adjusted so as to sufficiently stir slurry, the temperature thereof is raised. At this time, the temperature raising rate is 0.2° C./minute until the temperature reaches 40° C. and is 0.05° C./minute from when the temperature exceeds 40° C. Then, the particle diameter is measured by a multisizer II (manufactured by Coulter Corporation, aperture diameter of 50 μm) for each of 10 minutes. When the volume average particle diameter is 5.0 μm, the temperature is held, and 170 parts of the resin coating particle dispersion (B1) as a material for forming a shell are put into the reaction vessel for 5 minutes. The resultant is held for 30 minutes, and then pH is adjusted to 9.0 by using a 1% sodium hydroxide aqueous solution. Then, while pH is adjusted for each 5° C. in the similar manner, so as to cause pH to be 9.0, the temperature is raised up to 90° C. at a temperature raising rate of 1° C./minute, and then holding is performed at 98° C. When a particle shape and surface properties are observed by an optical microscope and a scanning electron microscope (FE-SEM), the vessel is cooled up to 30° C. for 5 minutes by using cooling water because unification of particles is confirmed when 10.0 hours elapse.

The cooled slurry is caused to pass through a nylon mesh having openings of 15 μm. Thus, coarse particles are removed, and nano-slurry obtained by passing through the mesh is filtered at reduced pressure in an aspirator. The toner remaining on filter paper is ground by hands as fine as possible, and is put into ion exchange water at a temperature of 30° C. The amount of the ion exchange water is 10 times the amount of the toner. The toner and the water are mixed by stirring for 30 minutes. Subsequently, the mixture is filtered at reduced pressure in the aspirator. The toner remaining on filter paper is ground by hands as fine as possible, and is put into ion exchange water at a temperature of 30° C. The amount of the ion exchange water is 10 times the amount of the toner. The toner and the water are mixed by stirring for 30 minutes. Then, filtering at reduced pressure is performed again in the aspirator, and electric conductivity of a filtrate is measured. This operation is repeated until the electric conductivity of the filtrate becomes 10 μS/cm or smaller. Then, the toner is washed. The washed toner is finely ground by a wet type or dry type granulating machine (Cole mill). Then, the toner is vacuum-dried in an oven of 35° C. for 36 hours, and thereby toner particles are obtained. The obtained toner particles have a volume average particle diameter of 5.8 μm.

Then, 1.5 parts of hydrophobic silica (RY50 manufactured by NIPPON AEROSIL CO., LTD.) are added to 100 parts of the obtained toner particle, and mixing is performed at 13000 rpm by using a sand mill for 30 seconds. Then, classifying is performed by a vibration sieve having openings of 45 μm, and thereby a toner in Example 1 is obtained.

Examples 2 to 11, Comparative Example 1

A toner in each of the examples is obtained by a method which is similar to that for the toner in Example 1 except that the type and the number of parts of the material for forming a core (core resin particle, oxidative polymerizable compound) and the material for forming a shell (resin particle dispersion for forming a shell) are changed in accordance with Table 1.

<Measurement>

Regarding the toner obtained in each of the examples, it is determined whether or not the sea-island structure is provided, by a known method. In addition, the major length of an island portion, and the thickness of a shell layer are measured by known methods.

In the toner in each of the examples, a sea-island structure which is configured by a sea portion including a high-Tg styrene resin and an island portion including a low-Tg (meth)acrylic acid ester resin is confirmed.

<Evaluation>

(Production of Developer)

36 parts of the toner in each of the examples and 414 parts of a carrier are put into a V blender having a size of 2 liters. Stirring is performed for 20 minutes, and then classifying is performed at 212 μm. Thereby, a developer in each of the examples is produced. The following resin coating carrier is used as the carrier.

—Preparation of Resin Coating Carrier—

Mn—Mg—Sr ferrite particle (average particle diameter of 40 μm): 100 parts

Toluene: 14 parts

Polymethyl methacrylate: 2.0 parts

Carbon black (VXC72 manufactured by Cabot Corporation): 0.12 parts

The component except for the ferrite particles, and glass beads (φ1 mm, the same amount as that of toluene) are stirred at 1200 rpm by using a sand mill (manufactured by KANSAI PAINT Co., Ltd.) for 30 minutes. Thereby, a solution for forming a resin coating layer is obtained. Further, the solution for forming a resin coating layer and the ferrite particles are put into a vacuum degassing type kneader, and pressure therein is reduced. Toluene is distilled and then the resultant is dried. Thereby, a resin coating carrier is prepared.

(Preparation of Evaluation Machine)

The developer in each of the examples is accommodated in a developing device of a device obtained by remodeling DocuPrintC2425 (manufactured by Fuji Xerox Co., Ltd.). In the remodeled device, a two-roll type fixing machine is remodeled so as to set the maximum fixing pressure to be 5 MPa (50 kgf/cm$^2$), and a process speed is adjusted to be 180 mm/sec. In the remodeled device, a fixing device does not include a heating source. A brush cleaner that removes a toner remaining on a photoconductor after transfer is provided.

The following evaluations are performed by using the remodeled device as an evaluation machine. Table 1 shows results.

(Evaluation for Deformation of Toner)

A solid image in which image density is 100% and the toner weight per unit area when the solid image is formed is 4 mg/cm$^2$ is printed, and 100 pieces of the solid image are continuously printed, by using the evaluation machine and C2 paper having a A4 size. Then, the developer is collected. The shape of a toner particle is observed by a scanning electron microscope (SEM), and comparison of the shape of the toner particle to that of a not-used toner particle is performed so as to perform sensory evaluation. The deformation of the toner is evaluated based on the following evaluation criteria.

—Evaluation Criteria—

A: Change of the shape is confirmed in the toner of smaller than 5% in comparison to the not-used toner.

B: Change or collapse of the shape thereof is viewed in the toner of 5% to 20%.

C: Change or collapse of the shape is viewed in the toner of greater than 20%. It is not possible to permit a practical use of this toner.

(Evaluation of Pressure Fixability)

A solid image in which image density is 100% and the toner weight per unit area when the solid image is formed is 4 mg/cm$^2$ is printed, and 100 pieces of the solid image are continuously printed, by using the evaluation machine and C2 paper having a A4 size. Then, cloth scrapping is performed, and image density before and after the scrapping is measured by using a spectral densitometer (X-Rite). As an image density ratio becomes closer to 1.0, fixing strength is improved, and pressure fixability becomes more excellent. Thus, the pressure fixability is evaluated based on the following evaluation criteria.

—Evaluation Criteria—

A: The image density ratio is equal to or greater than 0.9.

B: The image density ratio is 0.8 or greater and smaller than 0.9.

C: The image density ratio is 0.7 or greater and smaller than 0.8.

D: The image density ratio is smaller than 0.7. It is not possible to permit a practical use of this toner.

(Evaluation of Occurrence of Set-Off of Fixed Image)

A solid image having image density of 50% is continuously printed on one surface of paper having an A4 size (thin paper having a basis weight of 52 g/m2) by using the evaluation machine under a high temperature environment (under an environment of a temperature of 40° C. and humidity of 50% RH). Another piece of A4 paper is overlapped on an image-formed surface of the A4 paper, on which the image is formed. In the overlap state, letters (ABC) are drawn on the surface of this piece of A4 paper by using a pencil.

Then, this piece of A4 paper and the A4 paper on which the image is formed are separated from each other. Then, the back surface of this piece of A4 paper is observed, and thus the occurrence of set-off is evaluated based on the following evaluation criteria.

—Evaluation Criteria—

A: The set-off of the fixed image is not confirmed and a favorable image is obtained.

B: Although slight set-off of the fixed image partially occurs along a line drawn by the pencil, this is not an image defect, and a favorable image is obtained.

C: Although slight set-off of the fixed image occurs overall along a line drawn by the pencil, this is not an image defect, and a practical use of this toner can be permitted.

D: Set-off of the fixed image occurs overall along a line drawn by the pencil, and it is not possible to permit a practical use of this toner.

Details of each of the examples will be shown on the list of Table 1 and Table 2. In Table 1 and Table 2, abbreviations and the like are as follows.

—Field of Note—

High-Tg-Allyl: A high-Tg styrene resin includes an allyl group. A numerical value in parentheses indicates the content (mmol %) of the allyl group with respect to the resin.

LowTg-Allyl: A low-Tg (meth)acrylic acid ester resin includes an allyl group. A numerical value in parentheses indicates the content (mmol %) of the allyl group with respect to the resin.

Allyl: A resin of a shell layer includes an allyl group. A numerical value in parentheses indicates the content (mmol %) of the allyl group with respect to the resin.

—Field of Oxidative Polymerizable Compound—

OPC1: Linseed oil

OPC2: Safflower oil

OPC3: Urushiol

OPC4: Cardanol

A numerical value in parentheses in the field of the oxidative polymerizable compound indicates the content (% by weight) of the oxidative polymerizable compound with respect to the toner particle.

It is understood that the occurrence of set-off is prevented in the examples in comparison to the comparative examples, from the results.

It is also understood that, in the examples, deformation of the toner is also prevented and pressure fixability is also favorable.

It is understood that the occurrence of set-off is prevented in the example in which the resin including an allyl group is applied, in comparison to the comparative examples.

<Preparation of Core Resin Particle>

(Preparation of Core Resin Particle Dispersion (A11))

Styrene: 450 parts n-butyl acrylate: 135 parts

Acrylic acid: 12 parts

Dodecane thiol: 9 parts

A solution is prepared by mixing and dissolving the components.

10 parts of an anionic surfactant (DOWFAX2A1 manufactured by Dow Chemical Company) are dissolved in 250 parts of ion exchange water. The solution is added and is dispersed in a flask, so as to be emulsified (monomer emulsification liquid A).

TABLE 1

Characteristics and the like of core resin particle

| No | Glass transition temperature Tg1 (° C.) of high-Tg styrene resin | Glass transition temperature Tg2 (° C.) of low-Tg (meth)acrylic acid ester resin | Difference (° C.) between Tg1 and Tg2 | Note |
|---|---|---|---|---|
| (A1) | 53 | −70 | 123 | |
| (A2) | 53 | −55 | 108 | |
| (A3) | 53 | −20 | 73 | |
| (A4) | 56 | −70 | 126 | High-Tg Allyl (8 mmol %) |
| (A5) | 53 | −50 | 103 | Low-Tg Allyl (8 mmol %) |

Characteristics and the like of shell-layer resin particle

| No | Glass transition temperature Tg (° C.) | Note |
|---|---|---|
| (B1) | 53 | Allyl (8 mmol %) |
| (B2) | 85 | |
| (B3) | 62 | Allyl (15 mmol %) |
| (B4) | 49 | |

TABLE 2

| | Material for forming core | | Material for shell | Toner characteristics | | | Evaluation | | |
|---|---|---|---|---|---|---|---|---|---|
| | Core resin particle dispersion Type/number of parts | Oxidative polymerizable compound Type/number of parts (content to toner particle) | Shell-layer resin particle dispersion layer Type/number of parts | Presence or absence of sea-island structure | Major length (μm) of island portion | Thickness (μm) of shell layer | Deformation of toner | Pressure fixability | Set-off |
| Example 1 | (A1)/504 | (OPC1)/25 (3.4%) | (B1)/170 | Presence | 300 | 300 | A | A | A |
| Example 2 | (A1)/504 | (OPC2)/33 (5%) | (B1)/170 | Presence | 310 | 300 | A | A | A |
| Example 3 | (A1)/504 | (OPC3)/20 (2.7%) | (B1)/170 | Presence | 270 | 300 | A | A | A |
| Example 4 | (A1)/504 | (OPC4)/20 (2.7%) | (B1)/170 | Presence | 340 | 300 | A | A | A |
| Example 5 | (A2)/504 | (OPC1)/25 (3.4%) | (B1)/170 | Presence | 400 | 300 | A | B | A |
| Example 6 | (A3)/504 | (OPC1)/25 (3.4%) | (B1)/170 | Presence | 410 | 300 | B | B | B |
| Example 7 | (A1)/504 | (OPC1)/25 (3.4%) | (B2)/170 | Presence | 330 | 300 | A | B | B |
| Example 8 | (A4)/504 | (OPC1)/25 (3.4%) | (B1)/170 | Presence | 290 | 300 | A | B | B |
| Example 9 | (A5)/504 | (OPC1)/25 (3.4%) | (B1)/170 | Presence | 300 | 300 | A | B | B |
| Example 10 | (A1)/504 | (OPC1)/25 (3.4%) | (B3)/170 | Presence | 300 | 300 | A | B | A |
| Comparative Example 1 | (A1)/504 | Not added | (B1)/170 | Presence | 320 | 300 | A | A | C |
| Example 11 | (A1)/504 | (OPC1)/25 (3.4%) | (B4)/170 | Presence | 330 | 300 | C | C | B |

Further, 1 part of the same anionic surfactant (DOWFAX2A1 manufactured by Dow Chemical Company) is dissolved in 555 parts of ion exchange water and the resultant is put into a polymerization flask. A reflux tube is installed in the polymerization flask. Then, the polymerization flask is heated up to 75° C. in a water bath while nitrogen is injected and stirring is slowly performed. Then, the polymerization flask is held.

9 parts of ammonium persulfate are dissolved in 43 parts of ion exchange water. The resultant is dropped into the polymerization flask by a metering pump for 20 minutes. Then, the monomer emulsification liquid A is dropped by using a metering pump for 200 minutes.

Then, while stirring continues, the polymerization flask is held at 75° C. for 3 hours. Then, polymerization at a first stage is ended. Thus, a precursor of a core resin particle dispersion (A11), in which the center diameter of a particle is 190 nm, the glass transition temperature thereof is 53° C., and the weight average molecular weight thereof is 33,000 is obtained.

Then, after the temperature is decreased to room temperature, 600 parts of 2-ethylhexyl acrylate and 1500 parts of ion exchange water are added to the polymerization flask. Then, the resultant is slowly stirred for 2 hours. Then, while stirring continues, the temperature is raised to 70° C. 4.5 parts of ammonium persulfate and 110 parts of ion exchange water are dropped by using a metering pump form 20 minutes. Then, while stirring continues, the resultant is held for 3 hours, and then polymerization is ended. The core resin particle dispersion (A11) in which the center diameter is 260 nm, the weight average molecular weight is 200,000, and the solid content is 33% is obtained through the above-described processes.

Resin particles of the obtained core resin particle dispersion are dried, and a sample obtained by embedding the dried resin particle in an epoxy resin is produced. The sample is cut by a diamond knife, and thus a sectional slice of the resin particle is provided. A cut surface of the sample is colored in steam of ruthenium tetroxide, and then is confirmed by observation of a transmission electron microscope. As a result obtained by observing a section of the resin particle, it is confirmed that the resin particle has a configuration in which plural domains of a low-Tg (meth) acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −70° C. In addition, glass transition occurring by the high-Tg styrene resin is observed at 53° C. (glass transition temperature difference: 123° C.).

(Preparation of Core Resin Particle Dispersion (A12))

A core resin particle dispersion (A12) in which the volume average particle diameter is 265 nm and the solid content is 33% is obtained in a manner similar to that for the core resin particle dispersion (A11) except that 600 parts of n-butyl acrylate are used instead of 600 parts of 2-ethylhexyl acrylate.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −55° C. In addition, glass transition occurring by the high-Tg styrene resin is observed at 53° C. (glass transition temperature difference: 108° C.).

(Preparation of Core Resin Particle Dispersion (A13))

A core resin particle dispersion (A13) in which the volume average particle diameter is 268 nm and the solid content is 33% is obtained in a manner similar to that for the core resin particle dispersion (A11) except that 600 parts of ethyl acrylate are used instead of 600 parts of 2-ethylhexyl acrylate.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −20° C. In addition, glass transition occurring by the high-Tg styrene resin is observed at 53° C. (glass transition temperature difference: 73° C.).

(Preparation of Core Resin Particle Dispersion (A14))

A precursor of the core resin particle dispersion (1) is prepared. Then, a core resin particle dispersion (A14) in which the volume average particle diameter is 265 nm and the solid content is 33% is obtained in a manner similar to that for the core resin particle dispersion (A11) except that 600 parts of 2-ethylhexyl acrylate are changed to 900 parts, 1500 parts of ion exchange water are changed to 2100 parts, and 4.5 parts of ammonium persulfate are changed to 5.6 parts.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −70° C. In addition, glass transition occurring by the high-Tg styrene resin is observed at 53° C. (glass transition temperature difference: 123° C.).

(Preparation of Core Resin Particle Dispersion (A15))

A precursor of the core resin particle dispersion (1) is prepared. Then, a core resin particle dispersion (A15) in which the volume average particle diameter is 264 nm and the solid content is 33% is obtained in a manner similar to that for the core resin particle dispersion (A11) except that 600 parts of 2-ethylhexyl acrylate are changed to 400 parts, 1500 parts of ion exchange water are changed to 1100 parts, and 4.5 parts of ammonium persulfate are changed to 3 parts.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −70° C. In addition, glass transition occurring by the high-Tg styrene resin is observed at 53° C. (glass transition temperature difference: 123° C.).

(Preparation of Core Resin Particle Dispersion (A16))

A precursor of the core resin particle dispersion (1) is prepared. Then, a core resin particle dispersion (A16) in which the volume average particle diameter is 260 nm and the solid content is 33% is obtained in a manner similar to that for the core resin particle dispersion (A11) except that 588 parts of 2-ethylhexyl acrylate and 12 parts of a silicone compound (product name of X-22-174BX, manufactured by Shin-Etsu Chemical Co., Ltd.) are used instead of 600 parts of 2-ethylhexyl acrylate.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −72° C. In addition, glass transition occurring by the high-Tg styrene resin is observed at 53° C. (glass transition temperature difference: 125° C.).

(Preparation of Core Resin Particle Dispersion (A17))

A core resin particle dispersion (A17) in which the volume average particle diameter is 261 nm and the solid content is 33% is obtained in a manner similar to that for the core resin particle dispersion (A11) except that 123 parts of n-butyl acrylate and 12 parts of a silicone compound (product name of X-22-174BX, manufactured by Shin-Etsu Chemical Co., Ltd.) are used instead of 135 parts of n-butyl acrylate in the precursor of the core resin particle dispersion (1).

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −72° C. In addition, glass transition occurring by the high-Tg styrene resin is observed at 50° C. (glass transition temperature difference: 122° C.).

(Preparation of Core Resin Particle Dispersion (A18))

A precursor of the core resin particle dispersion (1) is prepared. Then, a core resin particle dispersion (A18) in which the volume average particle diameter is 264 nm and the solid content is 33% is obtained in a manner similar to that for the core resin particle dispersion (A11) except that 594 parts of 2-ethylhexyl acrylate and 6 parts of a silicone compound (product name of X-22-174BX, manufactured by Shin-Etsu Chemical Co., Ltd.) are used instead of 600 parts of 2-ethylhexyl acrylate.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −71° C. In addition, glass transition occurring by the high-Tg styrene resin is observed at 53° C. (glass transition temperature difference: 124° C.).

(Preparation of Core Resin Particle Dispersion (A19))

A precursor of the core resin particle dispersion (1) is prepared. Then, a core resin particle dispersion (A19) in which the volume average particle diameter is 264 nm and the solid content is 33% is obtained in a manner similar to that for the core resin particle dispersion (A11) except that 570 parts of 2-ethylhexyl acrylate and 30 parts of a silicone compound (product name of X-22-174BX, manufactured by Shin-Etsu Chemical Co., Ltd.) are used instead of 600 parts of 2-ethylhexyl acrylate.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −75° C. In addition, glass transition occurring by the high-Tg styrene resin is observed at 53° C. (glass transition temperature difference: 128° C.).

(Preparation of Comparative Core Resin Particle Dispersion (AC1): Dispersion Used in Example 1 in JP-A-2009-053318)

300 parts of ion exchange water and 1.5 parts of TTAB (Tetradecyl trimethylammonium bromide manufactured by Sigma-Aldrich Co. LLC.) are put into a round glass flask. Then, nitrogen bubbling is performed for 20 minutes. The temperature thereof is raised up to 65° C. while stirring is performed. 40 parts of an n-butyl acrylate monomer are added, and then stirring is further performed for 20 minutes. 0.5 parts of an initiator V-50 (2,2'-azobis(2-methylpropion amidine)dihydrochloride manufactured by Wako Pure Chemical Industries, Ltd.) are dissolved in 10 parts of ion exchange water. Then, the resultant is put into the flask. Holding is performed at 65° C. for 3 hours. Then, an emulsification liquid obtained in a manner that 55 parts of a styrene monomer, 15 parts of an n-butyl acrylate monomer, 2.5 parts of acrylic acid, and 0.8 parts of dodecane thiol are emulsified in 100 parts of ion exchange water in which 0.5 parts of TTAB are dissolved is continuously put into the flask by using a metering pump for 2 hours. The temperature is raised to 70° C., and holding is further performed for 2 hours. Then, polymerization is completed.

A comparative core resin particle dispersion (AC1) in which the volume average particle diameter is 150 nm and the solid content is 25% is obtained through the above-described processes.

Regarding resin particles of the obtained core resin particle dispersion, when a section of the resin particle is observed in a manner similar to that for the core resin particle dispersion (A11), it is confirmed that the resin particle has a core-shell structure in which a styrene-butyl acrylate-acrylic acid copolymer (high-Tg styrene resin) is used for the core and the core is coated with a polybutyl acrylate resin (low-Tg (meth)acrylic acid ester resin).

Regarding the dried resin particle, if the motion of Tg from −150° C. is analyzed by a differential scanning calorimeter (DSC) manufactured by Shimadzu Seisaku-sho Ltd., glass transition occurring by polybutyl acrylate (low-Tg (meth)acrylic acid ester resin) is observed at −50° C. In addition, glass transition occurring by a styrene-butyl acrylate-acrylic acid copolymer (high-Tg styrene resin) is observed at 56° C. (glass transition temperature difference: 106° C.).

(Preparation of Comparative Core Resin Particle Dispersion (AC21): One of Two Kinds of Dispersions Used in Example 1 in JP-A-2009-244857)

Styrene: 450 parts
n-butyl acrylate: 150 parts
Acrylic acid: 12 parts
Dodecane thiol: 9 parts A solution is prepared by mixing and dissolving the components.

20 parts of an anionic surfactant (DOWFAX2A1 manufactured by Dow Chemical Company) are dissolved in 250 parts of ion exchange water. The solution is added and is dispersed in a flask, so as to be emulsified (monomer emulsification liquid A).

Further, 3 parts of the same anionic surfactant (DOWFAX2A1 manufactured by Dow Chemical Company) are dissolved in 555 parts of ion exchange water and the resultant is put into a polymerization flask.

The polymerization flask is tightly capped. A reflux tube is installed in the reflux tube is installed. Then, the polymerization flask is heated up to 75° C. in a water bath while nitrogen is injected and stirring is slowly performed. Then, the polymerization flask is held.

9 parts of ammonium persulfate are dissolved in 43 parts of ion exchange water. The resultant is dropped into the polymerization flask by a metering pump for 20 minutes. Then, the monomer emulsification liquid A is dropped by using a metering pump for 200 minutes.

Then, while stirring continues slowly, the polymerization flask is held at 75° C. for 3 hours. Then, polymerization is ended.

A comparative core resin particle dispersion (AC21) in which the volume average particle diameter is 75 nm, the glass transition temperature is 51° C., the weight average molecular weight is 29,000, and the solid content is 25% is obtained through the above-described processes.

(Preparation of Comparative Core Resin Particle Dispersion (AC22): One of Two Kinds of Dispersions Used in Example 1 in JP-A-2009-244857)

Styrene: 100 parts
n-butyl acrylate: 500 parts
Acrylic acid: 12 parts
Dodecane thiol: 9 parts A solution is prepared by mixing and dissolving the components.

20 parts of an anionic surfactant (DOWFAX2A1 manufactured by Dow Chemical Company) are dissolved in 250 parts of ion exchange water. The solution is added and is dispersed in a flask, so as to be emulsified (monomer emulsification liquid B).

Further, 3 parts of the same anionic surfactant (DOWFAX2A1 manufactured by Dow Chemical Company) are dissolved in 555 parts of ion exchange water and the resultant is put into a polymerization flask.

The polymerization flask is tightly capped. A reflux tube is installed in the reflux tube is installed. Then, the polymerization flask is heated up to 75° C. in a water bath while nitrogen is injected and stirring is slowly performed. Then, the polymerization flask is held.

9 parts of ammonium persulfate are dissolved in 43 parts of ion exchange water. The resultant is dropped into the polymerization flask by a metering pump for 20 minutes. Then, the monomer emulsification liquid B is dropped by using a metering pump for 200 minutes.

Then, while stirring continues slowly, the polymerization flask is held at 75° C. for 3 hours. Then, polymerization is ended.

A comparative core resin particle dispersion (AC22) in which the volume average particle diameter is 50 nm, the glass transition temperature is 10° C., the weight average molecular weight is 26,000, and the solid content is 26% is obtained through the above-described processes.

(Preparation of Comparative Core Resin Particle Dispersion (AC3))

A precursor of the core resin particle dispersion (1) is prepared. Then, a core resin particle dispersion (AC3) in which the volume average particle diameter is 263 nm and the solid content is 33% is obtained in a manner similar to that for the core resin particle dispersion (A11) except that 600 parts of 2-ethylhexyl acrylate are changed to 1400 parts, 1500 parts of ion exchange water are changed to 3100 parts, and 4.5 parts of ammonium persulfate are changed to 10.5 parts.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −70° C. In addition, glass transition occurring by the high-Tg styrene resin is observed at 53° C. (glass transition temperature difference: 123° C.).

(Preparation of Comparative Core Resin Particle Dispersion (AC4))

A precursor of the core resin particle dispersion (1) is prepared. Then, a core resin particle dispersion (AC4) in which the volume average particle diameter is 261 nm and the solid content is 33% is obtained in a manner similar to that for the core resin particle dispersion (A11) except that 600 parts of 2-ethylhexyl acrylate are changed to 260 parts, 1500 parts of ion exchange water are changed to 810 parts, and 4.5 parts of ammonium persulfate are changed to 2 parts.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −70° C. In addition, glass transition occurring by the high-Tg styrene resin is observed at 53° C. (glass transition temperature difference: 123° C.).

(Preparation of Comparative Core Resin Particle Dispersion (AC5))

A precursor of the core resin particle dispersion (1) is prepared. Then, a core resin particle dispersion (AC5) in which the volume average particle diameter is 264 nm and the solid content is 33% is obtained in a manner similar to that for the core resin particle dispersion (A11) except that 597 parts of 2-ethylhexyl acrylate and 3 parts of a silicone compound (product name of X-22-174BX, manufactured by Shin-Etsu Chemical Co., Ltd.) are used instead of 600 parts of 2-ethylhexyl acrylate.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −70.5° C. In addition, glass transition occurring by the high-Tg styrene resin is observed at 53° C. (glass transition temperature difference: 123.5° C.).

(Preparation of Comparative Core Resin Particle Dispersion (AC6))

A precursor of the core resin particle dispersion (1) is prepared. Then, a core resin particle dispersion (AC6) in which the volume average particle diameter is 265 nm and the solid content is 33% is obtained in a manner similar to that for the core resin particle dispersion (A11) except that 362 parts of 2-ethylhexyl acrylate and 138 parts of a silicone compound (product name of X-22-174BX, manufactured by Shin-Etsu Chemical Co., Ltd.) are used instead of 600 parts of 2-ethylhexyl acrylate.

Regarding resin particles of the obtained core resin particle dispersion, when a section of the resin particle is observed in a manner similar to that for the core resin particle dispersion (A11), it is confirmed that the resin particle has a configuration in which plural domains of a low-Tg (meth)acrylic acid ester resin are dispersed in a high-Tg styrene resin which functions as a base material.

Regarding the dried resin particle, if the motion of the glass transition temperature Tg from −150° C. is analyzed by a differential scanning calorimeter (DSC) manufactured by Shimadzu Seisaku-sho Ltd., glass transition occurring by the low-Tg (meth)acrylic acid ester resin is observed at −80° C. In addition, glass transition occurring by the high-Tg styrene resin is observed at 53° C. (glass transition temperature difference: 133° C.).

<Preparation of Resin Coating Particle Dispersion>

(Preparation of Resin Coating Particle Dispersion (B11))

Styrene: 450 parts
n-butyl acrylate: 135 parts
Acrylic acid: 12 parts
Dodecane thiol: 9 parts A solution is prepared by mixing and dissolving the components.

10 parts of an anionic surfactant (DOWFAX2A1 manufactured by Dow Chemical Company) are dissolved in 250 parts of ion exchange water. The solution is added and is dispersed in a flask, so as to be emulsified (monomer emulsification liquid A).

Further, 1 part of the same anionic surfactant (DOWFAX2A1 manufactured by Dow Chemical Company) is dissolved in 555 parts of ion exchange water and the resultant is put into a polymerization flask.

A reflux tube is installed in the polymerization flask. Then, the polymerization flask is heated up to 75° C. in a water bath while nitrogen is injected and stirring is slowly performed. Then, the polymerization flask is held.

9 parts of ammonium persulfate are dissolved in 43 parts of ion exchange water. The resultant is dropped into the polymerization flask by a metering pump for 20 minutes. Then, the monomer emulsification liquid A is dropped by using a metering pump for 200 minutes.

Then, while stirring continues, the polymerization flask is held at 75° C. for 3 hours. Then, polymerization at a first stage is ended. Thus, a resin coating particle dispersion (B11) in which the center diameter of a particle is 190 nm, the glass transition temperature thereof is 53° C., the weight average molecular weight thereof is 33,000, and the solid content is 42% is obtained.

(Preparation of Resin Coating Particle Dispersion (B12))

A resin coating particle dispersion (B12) in which the glass transition temperature is 50° C., the weight average molecular weight Mw is 32,000, the volume average particle diameter is 190 nm, and the solid content is 42% is obtained by a method which is similar to that for the resin coating particle dispersion (B11) except that 450 parts of styrene are changed to 440 parts, and 135 parts of n-butyl acrylate are changed to 145 parts.

(Preparation of Resin Coating Particle Dispersion (B13))

A resin coating particle dispersion (B13) in which the glass transition temperature is 60° C., the weight average molecular weight Mw is 31,000, the volume average particle diameter is 195 nm, and the solid content is 42% is obtained by a method which is similar to that for the resin coating particle dispersion (B11) except that 450 parts of styrene are changed to 480 parts, and 135 parts of n-butyl acrylate are changed to 105 parts.

(Preparation of Resin Coating Particle Dispersion (B14))

A resin coating particle dispersion (B14) in which the glass transition temperature is 50° C., the weight average molecular weight Mw is 31,000, the volume average particle diameter is 192 nm, and the solid content is 42% is obtained by a method which is similar to that for the resin coating particle dispersion (B11) except that 123 parts of n-butyl acrylate and 12 parts of a silicone compound (product name of X-22-174BX, manufactured by Shin-Etsu Chemical Co., Ltd.) are used instead of 135 parts of n-butyl acrylate.

(Preparation of Comparative Resin Coating Particle Dispersion (BC1))

A resin coating particle dispersion (BC1) in which the glass transition temperature is 47° C., the weight average molecular weight Mw is 34,000, the volume average particle diameter is 190 nm, and the solid content is 42% is obtained by a method which is similar to that for the resin coating particle dispersion (B1) except that 450 parts of styrene are changed to 425 parts and 135 parts of n-butyl acrylate are changed to 160 parts.

<Preparation of Colorant Particle Dispersion>

Cyan pigment: 1000 parts (Pigment Blue 15:3 (copper phthalocyanine) manufactured by Dainichiseika Color & Chemicals Mfg. Co., Ltd.)

Anionic surfactant: 15 parts (NEOGEN R manufactured by DKS Co. Ltd.)

Ion exchange water: 9000 parts

The components are mixed, and the mixture is dispersed by using an ultimizer as a high-pressure impact type dispersing machine, (HJP30006 manufactured by Sugino Machine Limited for 1 hour. Then, a colorant (cyan pigment) is dispersed, and thereby a colorant particle dispersion is prepared. In the colorant particle dispersion, the volume average particle diameter of the colorant (cyan pigment) is 160 nm and the solid concentration is 20%.

Example 12

Core resin particle dispersion (A11): 504 parts

Colorant particle dispersion: 63 parts

Ion exchange water: 710 parts

Anionic surfactant: 1 part (Dowfax2A1 manufactured by Dow Chemical Company)

The components as materials for forming a core are put into a reaction vessel which has a volume of 3 liters and includes a thermometer, a pH meter, and a stirrer. 1.0% nitric acid is added at a temperature of 25° C., and thus pH is adjusted to 3.0. Then, while being dispersed at 5,000 rpm in a homogenizer (ULTRA TURRAX T50 manufactured by IKA Japan Corp.), 23 parts of a prepared aluminum sulfate aqueous solution are added to the reaction vessel, and are dispersed for 6 minutes.

Then, a stirrer and a Mantle heater are installed in the reaction vessel. While the number of rotations of the stirrer is adjusted so as to sufficiently stir slurry, the temperature thereof is raised. At this time, the temperature raising rate is 0.2° C./minute until the temperature reaches 40° C. and is 0.05° C./minute from when the temperature exceeds 40° C. Then, the particle diameter is measured by a multisizer II (manufactured by Coulter Corporation, aperture diameter of 50 μm) for each of 10 minutes. When the volume average particle diameter is 5.0 μm, the temperature is held, and 170 parts of the resin coating particle dispersion (B1) as a material for forming a shell are put into the reaction vessel for 5 minutes. The resultant is held for 30 minutes, and then pH is adjusted to 6.0 by using a 1% sodium hydroxide aqueous solution. Then, while pH is adjusted for each 5° C. in the similar manner, so as to cause pH to be 6.0, the temperature is raised up to 90° C. at a temperature raising rate of 1° C./minute, and then holding is performed at 96° C. When a particle shape and surface properties are observed by an optical microscope and a scanning electron microscope (FE-SEM), the vessel is cooled up to 30° C. for 5 minutes by using cooling water because unification of particles is confirmed when 10.0 hours elapse.

The cooled slurry is caused to pass through a nylon mesh having openings of 15 μm. Thus, coarse particles are removed, and toner-slurry obtained by passing through the mesh is filtered at reduced pressure in an aspirator. The toner remaining on filter paper is ground by hands as fine as possible, and is put into ion exchange water at a temperature of 30° C. The amount of the ion exchange water is 10 times the amount of the toner. The toner and the water are mixed by stirring for 30 minutes. Subsequently, the mixture is filtered at reduced pressure in the aspirator. The toner remaining on filter paper is ground by hands as fine as possible, and is put into ion exchange water at a temperature of 30° C. The amount of the ion exchange water is 10 times the amount of the toner. The toner and the water are mixed by stirring for 30 minutes. Then, filtering at reduced pressure is performed again in the aspirator, and electric conductivity of a filtrate is measured. This operation is repeated until the electric conductivity of the filtrate becomes 10 μS/cm or smaller. Then, the toner is washed. The washed toner is finely ground by a wet type or dry type granulating machine (Cole mill). Then, the toner is vacuum-dried in an oven of 25° C. for 36 hours, and thereby toner particles are obtained. The obtained toner particles have a volume average particle diameter of 5.8 μm.

Then, 1.5 parts of hydrophobic silica (RY50 manufactured by NIPPON AEROSIL CO., LTD.) are added to 100 parts of the obtained toner particle, and mixing is performed at 13000 rpm by using a sand mill for 30 seconds. Then, classifying is performed by a vibration sieve having openings of 45 μm, and thereby a toner in Example 1 is obtained.

Examples 13 to 25, Comparative Examples 2 to 7

A toner in each of the examples is obtained by a method which is similar to that for the toner in Example 1 except that the type and the number of parts of the material for forming a core (core resin particle dispersion) and the material for forming a shell (resin particle dispersion for forming a shell) are changed in accordance with Table 4.

In Comparative Example 2, the comparative core resin particle dispersion (AC1) is used as the material for forming a shell (resin particle dispersion for forming a shell).

In Comparative Example 3, a treatment of adding the material for forming a shell (resin particle dispersion for forming a shell) is not performed.

<Measurement>

Regarding the toner obtained in each of the examples, it is determined whether or not the sea-island structure is provided, by a known method. In addition, the major length of an island portion, and the thickness of a shell layer are measured by known methods.

In the toner in each of the examples, a sea-island structure which is configured by a sea portion including a high-Tg styrene resin and an island portion including a low-Tg (meth)acrylic acid ester resin is confirmed.

<Evaluation>

(Production of Developer)

36 parts of the toner in each of the examples and 414 parts of a carrier are put into a V blender having a size of 2 liters. Stirring is performed for 20 minutes, and then classifying is performed at 212 μm. Thereby, a developer in each of the examples is produced. The following resin coating carrier is used as the carrier.

—Preparation of Resin Coating Carrier—

Mn—Mg—Sr ferrite particle (average particle diameter of 40 μm): 100 parts

Toluene: 14 parts

Polymethyl methacrylate: 2.0 parts

Carbon black (VXC72 manufactured by Cabot Corporation): 0.12 parts

The component except for the ferrite particles, and glass beads (φ1 mm, the same amount as that of toluene) are stirred at 1200 rpm by using a sand mill (manufactured by KANSAI PAINT Co., Ltd.) for 30 minutes. Thereby, a solution for forming a resin coating layer is obtained.

Further, the solution for forming a resin coating layer and the ferrite particles are put into a vacuum degassing type kneader, and pressure therein is reduced. Toluene is distilled and then the resultant is dried. Thereby, a resin coating carrier is prepared.

(Preparation of Evaluation Machine)

The developer in each of the examples is accommodated in a developing device of a device obtained by remodeling DocuPrintC2425 (manufactured by Fuji Xerox Co., Ltd.). In the remodeled device, a two-roll type fixing machine is remodeled so as to set the maximum fixing pressure to be 10 MPa (100 kgf/cm$^2$), and a process speed is adjusted to be 60 mm/sec. In the remodeled device, a fixing device does not include a heating source. A brush cleaner that removes a toner remaining on a photoconductor after transfer is provided.

The following evaluations are performed by using the remodeled device as an evaluation machine. Table 4 shows results.

(Evaluation for Deformation of Toner)

A solid image in which image density is 100% and the toner weight per unit area when the solid image is formed is 4 mg/cm$^2$ is printed, and 100 pieces of the solid image are continuously printed, by using the evaluation machine and C2 paper having a A4 size. Then, the developer is collected. The shape of a toner particle is observed by a scanning electron microscope (SEM), and comparison of the shape of the toner particle to that of a not-used toner particle is performed so as to perform sensory evaluation.

The deformation of the toner is evaluated based on the following evaluation criteria.

—Evaluation Criteria—

A: The shape is not changed in comparison to the not-used toner

B: Collapse is viewed at a portion of the toner (about 20% or smaller)

C: Collapse is viewed at the half or greater of the toner. It is not possible to permit a practical use of this toner.

(Evaluation of Developing Property)

A developing machine is caused to perform idle running for 10 minutes under an environment of a high temperature and high humidity (32° C./85% RH), by using the evaluation machine. Then, a developer in the developing machine is collected. Then, the toner and the carrier are separated from each other by using a jet sieve, and the particle diameter of the toner is measured.

The developing property is evaluated based on the following evaluation criteria.

—Evaluation Criteria—

A: The degree of variation in particle diameter is equal to or smaller than 5%.

B: The degree of variation in particle diameter is greater than 5% and smaller than 10%.

C: The degree of variation in particle diameter is greater than 10% and smaller than 20%, and there is no problem in practical use thereof.

D: The degree of variation in particle diameter is equal to or greater than 20%, fogging of a non-image portion and density unevenness of an image can be visually confirmed, and thus it is not possible to permit a practical use thereof.

(Evaluation of Cleaning Property)

The evaluation machine stays for 24 hours under an environment of a high temperature and high humidity (32° C./85% RH), in a state where the developer is put into the developing machine. Then, printing is continuously performed on 100 sheets, and it is visually confirmed whether or not filming occurs on the surface of a photoconductor. The developing property is evaluated based on the following evaluation criteria.

—Evaluation Criteria—

A: It is not possible to confirm the occurrence of filming.

B: Although the occurrence of filming can be confirmed by a loupe, an influence on an image is not viewed.

C: Although the occurrence of filming can be visually confirmed, an influence on an image is not viewed.

D: The occurrence of filming can be visually confirmed, the image is influenced, and thus it is not possible to permit a practical use thereof.

(Evaluation of Pressure Fixability)

A solid image in which image density is 100% and the toner weight per unit area when the solid image is formed is 4 mg/cm$^2$ is printed, and 100 pieces of the solid image are continuously printed, by using the evaluation machine and C2 paper having a A4 size. Then, cloth scrapping is performed, and image density before and after the scrapping is measured by using a spectral densitometer (X-Rite). As an image density ratio becomes closer to 1.0, fixing strength is improved, and pressure fixability becomes more excellent. Thus, the pressure fixability is evaluated based on the following evaluation criteria.

—Evaluation Criteria—

A: The image density ratio is equal to or greater than 0.9

B: The image density ratio is 0.8 or greater and smaller than 0.9

C: The image density ratio is 0.7 or greater and smaller than 0.8

D: The image density ratio is smaller than 0.7. It is not possible to permit a practical use of this toner.

(Evaluation of Occurrence of Document Offset (Set-Off of Fixed Image))

A solid image in which image density is 100% and the toner weight per unit area when the solid image is formed is 4 mg/cm$^2$ is continuously printed on both surfaces of 50 sheets of paper having a A4 size (thin paper having a basis weight of 52 g/m$^2$), by using the evaluation machine under a high temperature environment (under an environment of a temperature of 50° C. and humidity of 50% RH). Then, the sheets of A4 paper on which the image is formed are overlapped. After 5 hours elapse, a place of the second printed sheet of paper, in which the second printed sheet comes into contact with an image on the first sheet of paper is observed. An occurrence of document blocking is evaluated based on the following evaluation criteria.

—Evaluation Criteria—

A: No occurrence of set-off of a fixed image is confirmed, and a very favorable image is obtained.

B: Although very slight set-off of the fixed image partially occurs on paper, this is not an image defect, and a favorable image is obtained.

C: Although slight set-off of the fixed image occurs on the entire surface of paper, this is not an image defect, and a practical use of this toner can be permitted.

D: Set-off of the fixed image occurs, an image defect is formed, and thus it is not possible to permit a practical use thereof.

Details of each of the examples will be shown on the list of Table 3 and Table 4. In Table 3 and Table 4, abbreviations and the like are as follows.

—Field of Internal State of Particle—

DB: Configuration in which plural domains of a low-Tg (meth)acrylic acid ester resin are dispersed in a high-Tg styrene resin which functions as a base material —Field of Note—

High-Tg-S: A high-Tg styrene resin includes a siloxane structure. A part in parentheses indicates the percentage (% by weight) of the siloxane structure shown in the resin.

Low-Tg-S: A low-Tg (meth)acrylic acid ester resin includes a siloxane structure. A part in parentheses indicates the percentage (% by weight) of the siloxane structure shown in the resin.

S: The resin of a shell layer includes a siloxane structure.

A numerical value in parentheses in the field of Note indicates the percentage (% by weight) of the siloxane structure shown in the resin.

TABLE 3

Characteristics and the like of core resin particle

| No | Glass transition temperature Tg1 (° C.) of high-Tg styrene resin | Glass transition temperature Tg2 (° C.) of low-Tg (meth)acrylic acid ester resin | Difference (° C.) between Tg1 and Tg2 | Weight ratio of high-Tg and low-Tg | Internal state of particle | Note |
|---|---|---|---|---|---|---|
| (A11) | 53 | −70 | 123 | 50/50 | DB | |
| (A12) | 53 | −55 | 108 | 50/50 | DB | |
| (A13) | 53 | −20 | 73 | 50/50 | DB | |
| (A14) | 53 | −70 | 123 | 40/60 | DB | |
| (A15) | 53 | −70 | 123 | 60/40 | DB | |
| (A16) | 53 | −72 | 125 | 50/50 | DB | Low-Tg-S (2%) |
| (A17) | 50 | −72 | 122 | 50/50 | DB | High-Tg-S (2%) |
| (A18) | 53 | −71 | 124 | 50/50 | DB | Low-Tg-S (1%) |
| (A19) | 53 | −75 | 128 | 50/50 | DB | Low-Tg-S (5%) |
| (AC1) | 56 | −50 | 106 | 64/36 | | |
| (AC21) | 51 | — | — | 100/0 | | |
| (AC22) | — | 10 | — | 0/100 | | |
| (AC3) | 53 | −70 | 123 | 30/70 | | |
| (AC4) | 53 | −70 | 123 | 70/30 | | |
| (AC5) | 53 | −70.5 | 123.5 | 50/50 | | Low-Tg-S (0.5%) |

Characteristics and the like of shell-layer resin particle

| No | Glass transition temperature Tg (° C.) | Note |
|---|---|---|
| (B11) | 53 | |
| (B12) | 50 | |
| (B13) | 60 | |
| (B14) | 50 | S (2%) |
| (BC1) | 47 | |

TABLE 4

| | Material for core (core resin particle dispersion) Type/number of parts | Material for shell layer (shell-layer resin particle dispersion) Type/number of parts | Toner characteristics: Presence or absence of sea-island structure | Toner characteristics: Major length (nm) of island portion | Toner characteristics: Thickness (nm) of shell layer | Evaluation: Deformation of toner | Evaluation: Developing property | Evaluation: Cleaning property | Evaluation: Pressure fixability | Evaluation: Set-off |
|---|---|---|---|---|---|---|---|---|---|---|
| Example 13 | (A11)/504 | (B11)/170 | Presence | 300 | 300 | A | A | A | B | D |
| Example 14 | (A14)/504 | (B11)/170 | Presence | 500 | 300 | A | A | A | B | D |
| Example 15 | (A15)/504 | (B11)/170 | Presence | 200 | 300 | B | B | B | A | D |
| Example 16 | (A12)/504 | (B11)/170 | Presence | 280 | 300 | A | A | A | B | D |
| Example 17 | (A13)/504 | (B11)/170 | Presence | 270 | 300 | A | A | A | C | D |
| Example 18 | (A11)/504 | (B12)/170 | Presence | 300 | 300 | B | B | B | A | D |
| Example 19 | (A11)/504 | (B13)/170 | Presence | 300 | 300 | A | A | A | C | C |
| Example 20 | (A16)/504 | (B11)/170 | Presence | 330 | 300 | A | A | A | B | A |
| Example 21 | (A17)/504 | (B11)/170 | Presence | 330 | 300 | A | A | A | C | C |
| Example 22 | (A11)/504 | (B14)/170 | Presence | 330 | 300 | B | C | C | C | B |
| Example 23 | (A18)/504 | (B11)/170 | Presence | 300 | 300 | A | A | A | B | C |
| Example 24 | (A19)/504 | (B11)/170 | Presence | 320 | 300 | B | C | C | C | A |
| Example 25 | (A11)/504 | (B11)/103 | Presence | 350 | 170 | B | C | C | A | D |
| Example 26 | (AC5)/504 | (B11)/170 | Presence | 300 | 300 | A | B | B | B | D |
| Comparative Example 2 | (AC1)/504 | (AC1)/170 | Presence | 550 | 300 | C | D | D | A | D |
| Comparative Example 3 | (AC21)/252 (AC22)/252 | Not added | Presence | 170 | — | C | D | D | A | D |
| Comparative Example 4 | (AC3)/504 | (B11)/170 | Presence | 600 | 300 | A | B | B | D | C |

TABLE 4-continued

| | Material for core (core resin particle dispersion) Type/number of parts | Material for shell layer (shell-layer resin particle dispersion) Type/number of parts | Toner characteristics: Presence or absence of sea-island structure | Toner characteristics: Major length (nm) of island portion | Toner characteristics: Thickness (nm) of shell layer | Evaluation: Deformation of toner | Evaluation: Developing property | Evaluation: Cleaning property | Evaluation: Pressure fixability | Evaluation: Set-off |
|---|---|---|---|---|---|---|---|---|---|---|
| Comparative Example 5 | (AC4)/504 | (B11)/170 | Presence | 160 | 300 | C | D | D | A | D |
| Comparative Example 6 | (A11)/504 | (BC1)/170 | Presence | 300 | 300 | C | D | D | A | D |
| Comparative Example 7 | (A11)/584 | (B11)/90 | Presence | 300 | 100 | C | D | D | A | D |

It is understood that the deformation of the toner is prevented in the examples in comparison to the comparative examples, from the results.

It is also understood that, in the examples, the developing property, the cleaning property, and the pressure fixability are favorable.

It is understood that the occurrence of document offset is prevented in the example in which the resin including a siloxane structure (particularly, a low-Tg (meth)acrylic acid ester resin including a siloxane structure) is applied, in comparison to other examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A pressure fixation toner for developing an electrostatic charge image, comprising a styrene resin, a (meth)acrylic acid ester resin, and an oxidative polymerizable compound, the pressure fixation toner having a sea-island structure configured by a sea portion including the styrene resin and island portions including the (meth)acrylic acid ester resin, the (meth)acrylic acid ester resin having a glass transition temperature being lower than a glass transition temperature of the styrene resin by 30° C. or greater.

2. The pressure fixation toner for developing an electrostatic charge image according to claim 1, wherein at least one of the styrene resin or the (meth) acrylic acid ester resin is a resin including an allyl group.

3. The pressure fixation toner for developing an electrostatic charge image according to claim 1, wherein each of the island portions has a major length ranging from 200 nm to 450 nm.

4. The pressure fixation toner for developing an electrostatic charge image according to claim 1, wherein a ratio of a styrene monomer with respect to all monomer constituting the styrene resin ranges from 15% by weight to 95% by weight.

5. The pressure fixation toner for developing an electrostatic charge image according to claim 1, wherein the (meth)acrylic acid ester resin has a glass transition temperature being lower than 10° C.

6. The pressure fixation toner for developing an electrostatic charge image according to claim 1, wherein the (meth)acrylic acid ester is a (meth)acrylic acid alkyl ester having an alkyl group having 2 to 22 carbon atoms.

7. The pressure fixation toner for developing an electrostatic charge image according to claim 1, wherein the oxidative polymerizable compound is at least one selected from the group consisting of:

a phenol derivatives having a phenol group and an aliphatic hydrocarbon group bonded to the phenol, the aliphatic hydrocarbon group having an ethylenic double bond, and a drying oil.

8. The pressure fixation toner for developing an electrostatic charge image according to claim 7, wherein the phenol derivative is selected from a group consisting of anacardic acid, anagiganic acid, perranjic acid, ginkgotic acid, ginkgolinic acid, cardanol, cardol, methyl cardol, urushiol, thithiol, renghol, and laccole.

9. The pressure fixation toner for developing an electrostatic charge image according to claim 1, wherein the drying oil includes a fatty acid having an aliphatic hydrocarbon group having an ethylenic double bond.

10. The pressure fixation toner for developing an electrostatic charge image according to claim 1, wherein the oxidative polymerizable compound has an iodine number being equal to or greater than 130 g/100 g.

11. The pressure fixation toner for developing an electrostatic charge image according to claim 1, the toner comprising:

a core which includes the styrene resin, the (meth)acrylic acid ester resin, and the oxidative polymerizable compound and has the sea-island structure; and a coating layer which coats the core and includes a resin having a glass transition temperature of 50° C. or higher.

12. The pressure fixation toner for developing an electrostatic charge image according to claim 11, wherein the resin in the coating layer is a styrene resin having an allyl group.

13. The pressure fixation toner for developing an electrostatic charge image according to claim 11, wherein the coating layer has a thickness ranging from 140 nm to 550 nm.

14. The pressure fixation toner for developing an electrostatic charge image according to claim 1, wherein the toner satisfies the following formula 1:

$$20° \text{ C.} \leq T(1 \text{ MPa}) - T(10 \text{ MPa}) \quad \text{Formula 1:}$$

wherein T(1 MPa) represents a temperature of the toner having a viscosity of 104 Pa·s at applied pressure of 1 MPa and is measured with a flow tester, and T(10 MPa) represents a temperature of the toner having a viscosity of 104 Pa·s at applied pressure of 10 MPa and is measured with a flow tester.

15. The pressure fixation toner for developing an electrostatic charge image according to claim 14, wherein the T(10 MPa) is equal to or smaller than 140° C.

16. The pressure fixation toner for developing an electrostatic charge image according to claim 1, including toner particles having an average circularity from 0.94 to 1.00.

17. An electrostatic charge image developer comprising the pressure fixation toner for developing an electrostatic charge image according to claim 1.

18. A toner cartridge configured to detach from an image forming apparatus, the toner cartridge accommodates the pressure fixation toner for developing an electrostatic charge image according to claim 1.

19. The pressure fixation toner for developing an electrostatic charge image according to claim 1, wherein a content of the oxidative polymerizable compound is from 1% by weight to 25% by weight with respect to the pressure fixation toner.

20. The pressure fixation toner for developing an electrostatic charge image according to claim 1, wherein the aliphatic hydrocarbon group having an ethylenic double bond is selected from a group consisting of palmitoleic acid, oleic acid, linoleic acid, and linolenic acid.

* * * * *